US011780653B2

(12) United States Patent
Rognard et al.

(10) Patent No.: US 11,780,653 B2
(45) Date of Patent: Oct. 10, 2023

(54) TAMPER EVIDENT CONTAINER CLOSURE

(71) Applicant: Obrist Closures Switzerland GmbH, Reinach (CH)

(72) Inventors: Jean-Yves Rognard, Saint-Georges-de-Reneins (FR); Axel Rognard, Saint-Georges-de-Reneins (FR)

(73) Assignee: Obrist Closures Switzerland GmbH, Reinach (CH)

( * ) Notice: Subject to any disclaimer, the term of this patent is extended or adjusted under 35 U.S.C. 154(b) by 75 days.

(21) Appl. No.: 17/255,504

(22) PCT Filed: Jul. 3, 2019

(86) PCT No.: PCT/EP2019/067923
§ 371 (c)(1),
(2) Date: Dec. 23, 2020

(87) PCT Pub. No.: WO2020/007956
PCT Pub. Date: Jan. 9, 2020

(65) Prior Publication Data

US 2021/0269198 A1 Sep. 2, 2021

(30) Foreign Application Priority Data

Jul. 3, 2018 (GB) ..... 1810931
Dec. 21, 2018 (GB) ..... 1821038

(51) Int. Cl.
*B65D 41/48* (2006.01)
*B65D 51/24* (2006.01)

(52) U.S. Cl.
CPC ..... *B65D 41/485* (2013.01); *B65D 51/242* (2013.01); *B65D 2401/30* (2020.05); *B65D 2401/45* (2020.05)

(58) Field of Classification Search
CPC ..... B65D 41/485; B65D 51/242; B65D 2401/30; B65D 2401/45; B65D 2401/15;
(Continued)

(56) References Cited

U.S. PATENT DOCUMENTS 9,868,570 B2 1/2018 Ferrari et al.
2004/0245204 A1 12/2004 Suffa
(Continued)

FOREIGN PATENT DOCUMENTS

IT 20169888 A1 7/2017
WO 2007/026194 A1 3/2007
WO 2017068151 A1 4/2017

OTHER PUBLICATIONS

Jan. 22, 2020—(WO) International Search Report and Written Opinion—Appl. No. PCT/EP2019/067923.

*Primary Examiner* — Shawn M Braden
(74) *Attorney, Agent, or Firm* — Banner & Witcoff, Ltd.

(57) ABSTRACT

A tamper-evident container closure (10) is provided and comprises a base (15) and a lid (20). The base and lid are connected together by a hinge (25) so that the lid can be moved between a closed position and an open position. The base is attachable to a container neck. Generally opposite the hinge the lid includes a retention member (35), the retention member includes or defines a window (39) and includes a retention portion for engagement with a cooperating portion on the closure and/or on a container neck for holding the lid in a closed position. The closure includes a tamper-evident member (40) at least part of which moves into or out of view with respect to the window to indicate opening of the closure.

20 Claims, 33 Drawing Sheets

(58) Field of Classification Search
CPC ... B65D 2401/20; B65D 47/08; B65D 55/024
See application file for complete search history.

(56) References Cited

U.S. PATENT DOCUMENTS

| | | | | |
|---|---|---|---|---|
| 2008/0110933 | A1 | 5/2008 | Goncalves | |
| 2008/0277371 | A1 | 11/2008 | Weist | |
| 2012/0091160 | A1* | 4/2012 | Rognard | B65D 47/0842<br>220/257.1 |
| 2018/0162606 | A1* | 6/2018 | Zeng | B65D 47/08 |
| 2019/0367232 | A1* | 12/2019 | Bai | B65D 85/60 |

* cited by examiner

TAMPER EVIDENT CONTAINER CLOSURE

CROSS-REFERENCE TO RELATED APPLICATIONS

This application is a U.S. National Stage application under 35 U.S.C. § 371 of International Application PCT/EP2019/067923 (published as WO 2020/007956), filed Jul. 3, 2019, which claims the benefit of priority to U.K. Application No. 1810931.4, filed Jul. 3, 2018, and U.K. Application No. 1821038.5, filed Dec. 21, 2018. Each of these prior applications is hereby incorporated by reference in their entirety.

The present invention relates generally to a closure and particularly, although not exclusively, to a hinge cap.

An aspect of the present invention provides a tamper-evident container closure comprising a base and a lid, the base and lid are connected together by a hinge so that the lid can be moved between a closed position and an open position, the base is attachable to a container neck, generally opposite the hinge the lid includes a retention member, the retention member includes or defines a window and includes a retention portion for engagement with a cooperating portion on the closure and/or on a container neck for holding the lid in a closed position, the closure includes a tamper-evident member at least part of which moves into or out of view with respect to the window to indicate opening of the closure.

In some embodiments a tamper-evident member moves (fall example falls) out of a window or out of register with a window. In other embodiments a tamper-evident member moves (for example falls) into or into registration with a window.

In some embodiments the retention portion engages part of the lid; in other embodiments the retention portion engages part of the base; in other embodiments the retention portion engages a container neck, for example a bead, screw thread formation or the like formed on the neck.

In an initially closed position the tamper-evident member may be visible in and/or through the window and when the lid is moved to the open position the tamper-evident may move at least partly out of view.

The tamper evident member may be attached to the lid in the window in an initially closed position and may move at least partly out of, or out of alignment with, the window when the lid is opened.

When the lid is initially opened the tamper-evident member may irreversibly move to become visible in or through the window. Features such as undercuts, hooks, ledges and the like may be used to retain a member in a position indicating the lid has been opened at least once.

The tamper-evident member may be formed separately from the base and lid.

The tamper-evident member may comprise or consist of one or more rings. For example the tamper-evident member may comprise two rings. The rings may be initially frangibly connected together, and when the lid is opened for the first time the rings may be caused to break apart. In some embodiments one of the rings may be retained by the lid and the other ring may move to become visible in or through the window.

The retention portion may comprise a depending loop. For example the retention member may be a generally hyoid shape.

The retention member may include a retention feature, such as an interior retention chin, for engagement with a cooperating portion on the closure and/or on a container neck. This can be used to help prevent the closure from opening accidentally e.g. in the event it is dropped.

At least part of the window may be formed as an aperture (i.e. no material).

At least part of the window may be formed as a pane (i.e. material through which the tamper-evident member or an absence thereof can be viewed).

At least part of the window may be formed as region of thinned material.

A further aspect provides a container closure comprising a base and a lid, the base and lid are connected together by a hinge so that the lid can be moved between a closed position and an open position, the base is attachable to a container neck, generally opposite the hinge the lid includes a generally hyoidal retention member, the retention member includes a retention chin, ledge or the like for engagement with a container neck.

A further aspect provides a container closure comprising a base and a lid, the base and lid are connected together by a hinge so that the lid can be moved between a closed position and an open position, the base is attachable to a container neck, generally opposite the hinge the lid includes a retention member, the retention member includes a retention portion for engagement with a cooperating portion on the closure and/or on a container neck.

A further aspect provides a tamper-evident closure comprising a base and a lid, the base and lid being joined by a hinge, generally opposite the hinge the lid includes a window, the closure further comprising a tamper-evident member, the tamper-evident member including a lifting projection for lifting the lid, in which when the lid is initially opened the tamper-evident member moves irreversibly so that at least part of the tamper-evident member becomes visible in or through the window.

The lifting projection may extend radially outwards from the lid. The projection is used to, or to help, lift the lid. The action of lifting the lid using the member causes the member to move from a first position to a second position; in doing so part of the member is moved into the window.

In aspects and embodiments of the present invention the lid may comprise a top plate.

The top plate may be generally flat.

The lid may comprise an annular plug seal which depends from the top plate.

The lid may comprise a sidewall that depends from the top plate.

The lid may be movable to a stable open position.

The hinge may be formed to provide the stable open position. The closure may be formed as a stable snap back closure. In some embodiments in the stable open the lid moves approximately 180°, in other embodiments the lid moves approximately 270°.

At least part of the closure may be formed from a non-opaque material.

The closure may be formed, for example moulded, in a closed position.

The closure may be formed, for example moulded, in an open position.

The closure may be formed as a one-piece article.

The closure may be formed as a two-piece article.

The base may be non-removably attachable to a container neck. For example the closure may be snap-on.

Closures may be configured for one-handed opening.

In some embodiments the retention member is formed as a hook.

In some embodiments the underside of the retention member serves as a lifting point.

The present invention also provides a closure as described herein in combination with a container.

Some aspects and embodiments provide a snap back one-piece closure.

Some aspects and embodiments provide a snap back two-piece closure.

In some aspects and embodiments the present invention relates at least partly to the design of a hook in the front of the cap.

The cap may, for example, be suitable for use with a 26 mm bottle neck.

GENERAL OVERVIEW OF ONE EMBODIMENT

This cap may be a hinge cap with snap back hinge feature. The hinge may be moulded in a closed position.

This cap may also have a drop band function such as a double ring tamper-evident feature (two rings which are frangibly connected together and which break apart axially when the lid is lifted/opened for the first time).

The design is efficient regarding the hooking of the lid cap and allow a better drop test result.

The design is done with a front window which allow an aggressive shape of the hook demoulded by slider into the mould. This window will procure also a good visibility of the drop band.

In an embodiment an upper tamper-evident ring is attached on the lid cap and a lower TE ring is attached on the body instead of the neck. This body design also is moulded in an opened position to have no hole surface outside.

In a further embodiment the body may be moulded in a closed position.

A further aspect provides a container stopper comprising a base part and a lid part, the base and the lid are joined by a hinge, the base includes a snap bead for non-removably engaging a container neck, the lid includes a lifting member for lifting the lid, the lifting member comprises a retention bead for engaging a container neck, the lifting member can be lifted to disengage the retention bead from the container neck so that the lid can be opened.

The lifting member may be a generally hyoidal shape strap which extends radially outwardly and downwardly from the lid generally opposite the hinge.

The retention bead on the lifting member may engage under a rim of the container neck.

The base may comprise a generally annular band with a generally annular snap bead provided on an interior surface thereof.

The lid may comprise a generally flat, disc-shape top plate and a generally annular sidewall which depends from the top plate.

The present invention also provides a container stopper as described herein in combination with a container having a neck.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combinations other than those explicitly set out in the claims.

Figure 1:
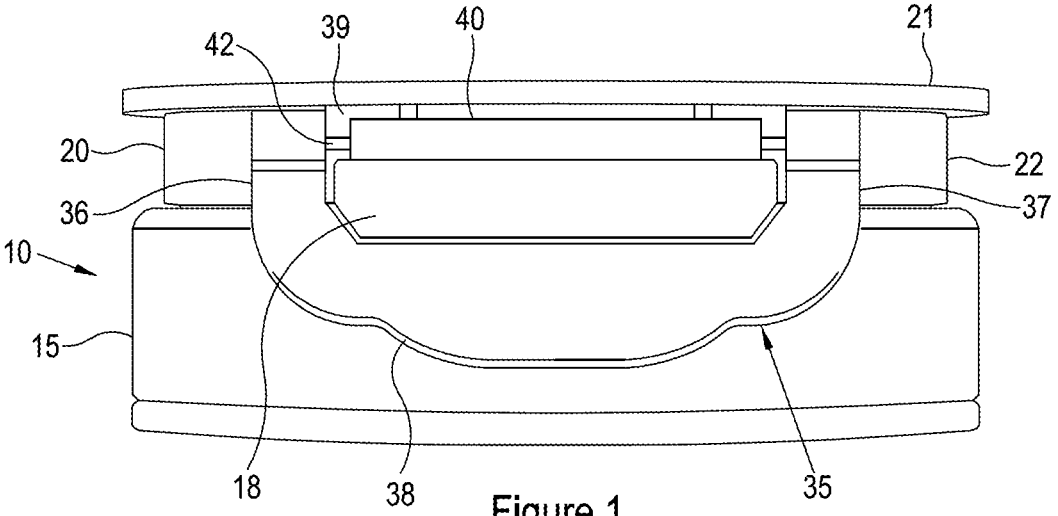
FIG. 1 is a front view of a one-piece, tamper-evident closure shown in a before opening position.
Figure 2:
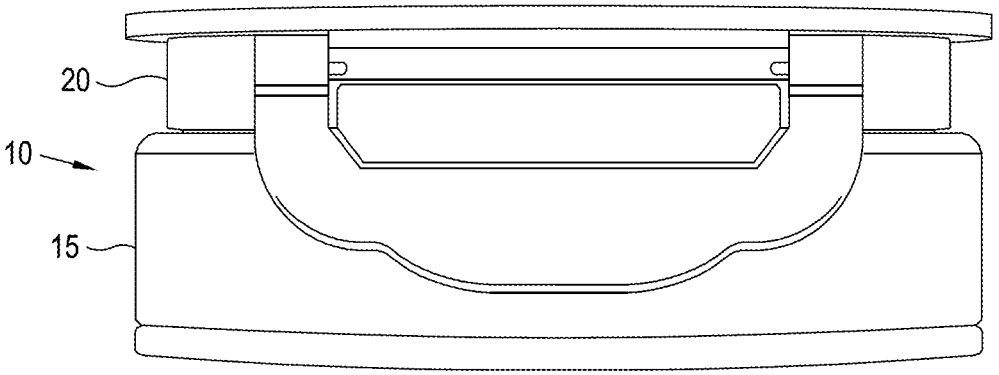
FIG. 2 shows the closure of FIG. 1 in a reclosed position.
Figure 3:
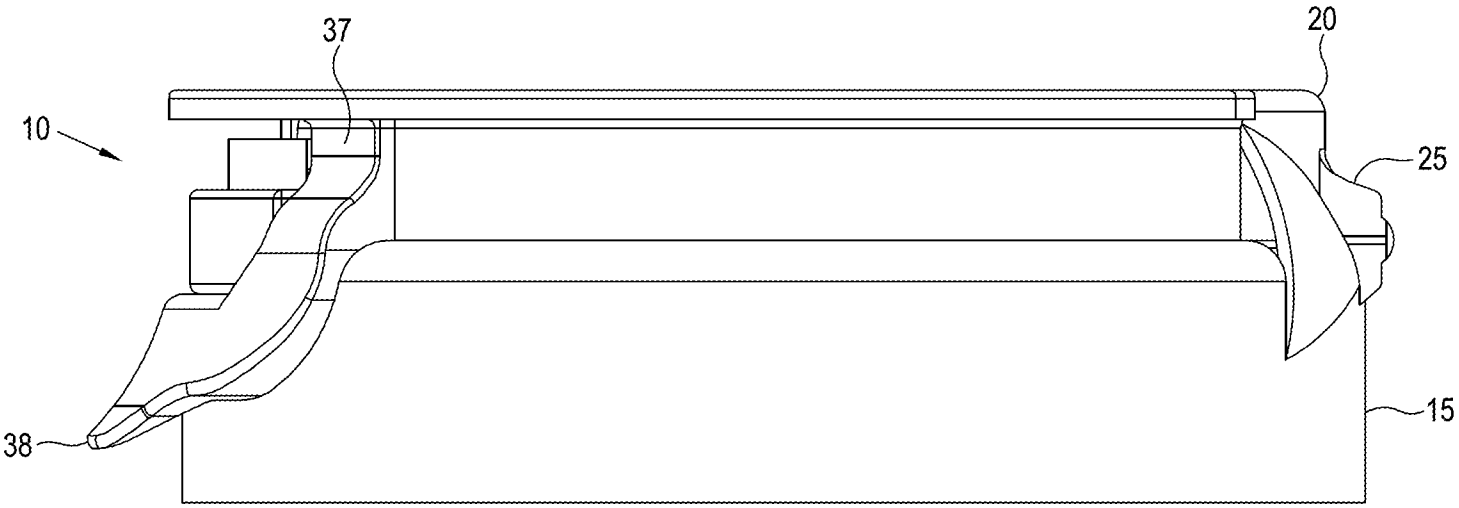
FIG. 3 is a side view of the closure of FIG. 1.
Figure 4:
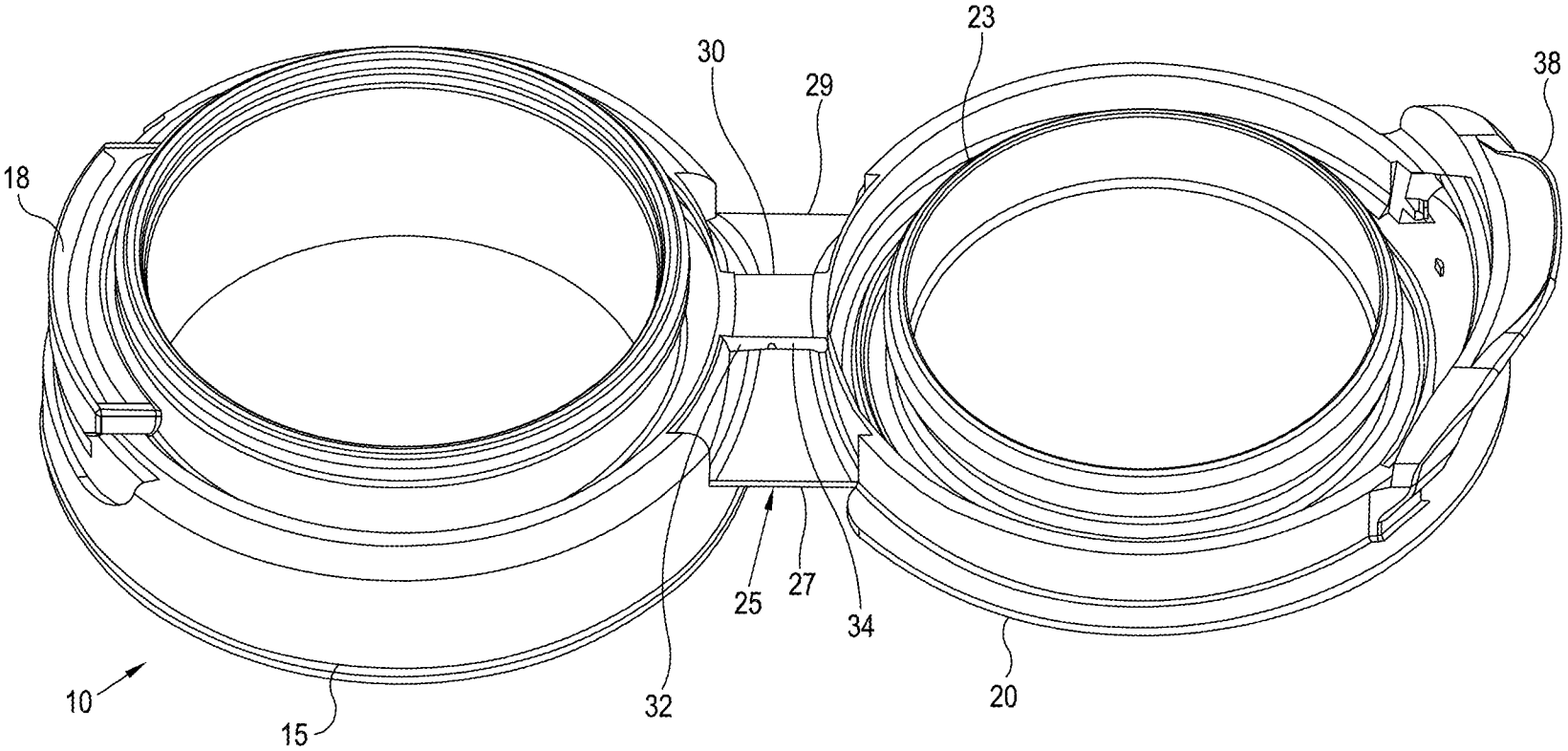
FIG. 4 shows the closure of FIG. 1 in an as-moulded position.
Figure 5:
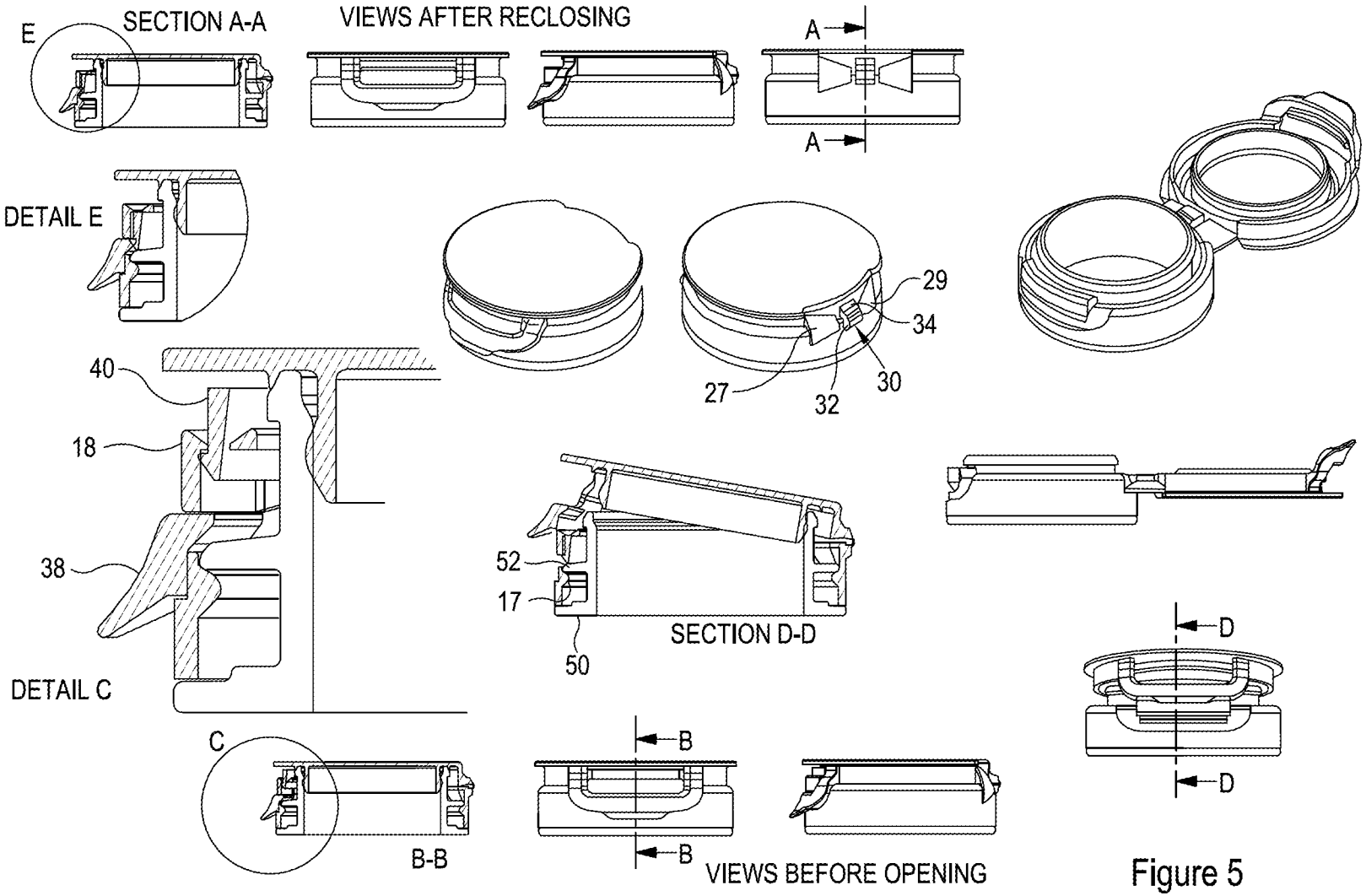
FIG. 5 shows various external and sectional views of the closure of FIGS. 1 to 4.
Figure 6:
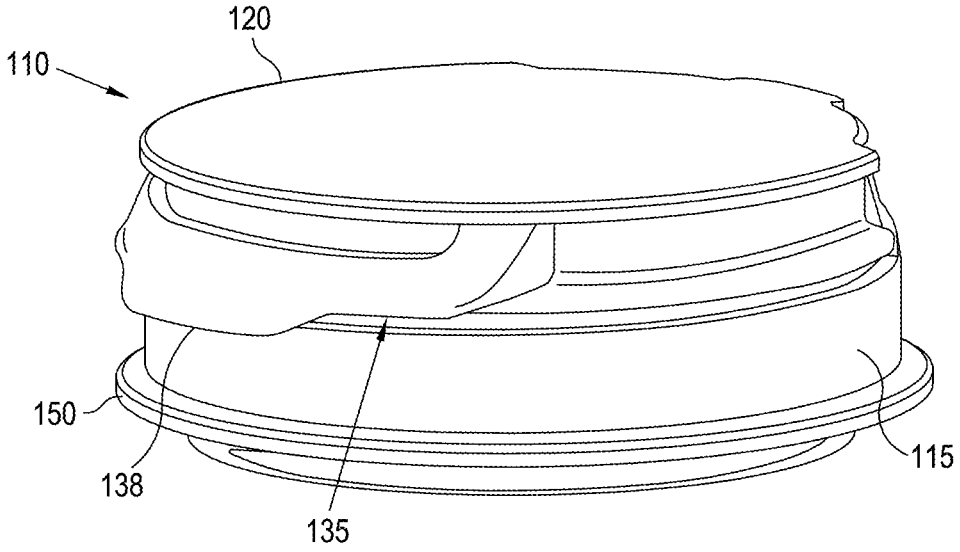
FIG. 6 shows a one-piece, non-detachable snap-on closure in a before opening position.
Figure 7:
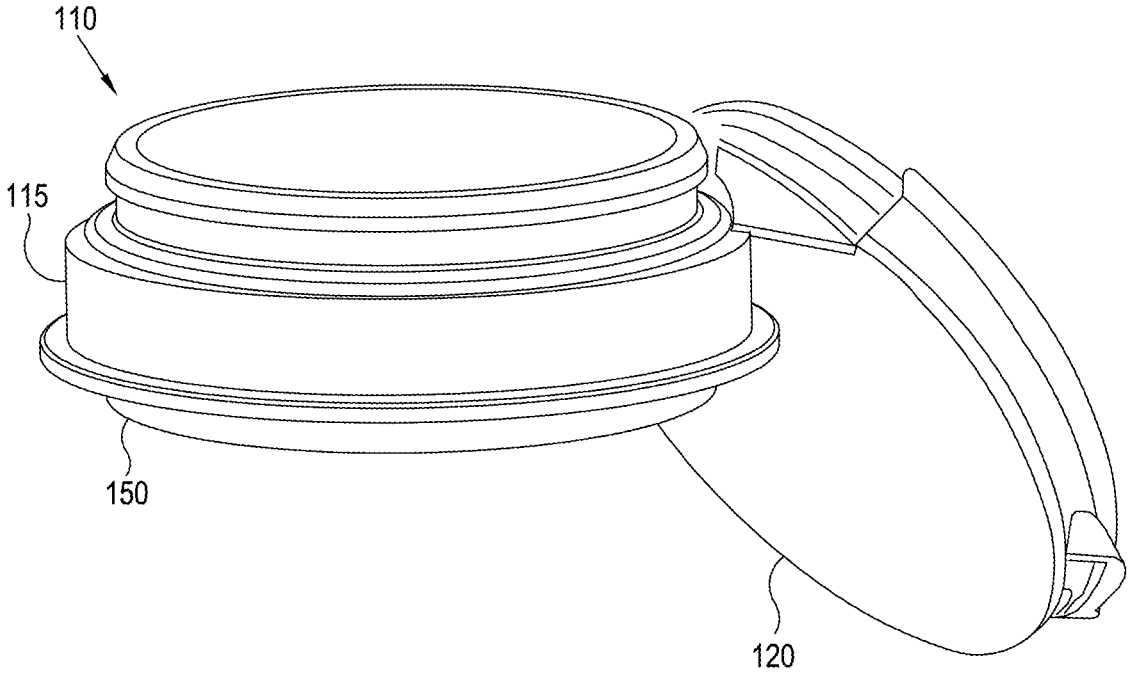
FIG. 7 shows the closure of FIG. 6 in an opened position.
Figure 8:
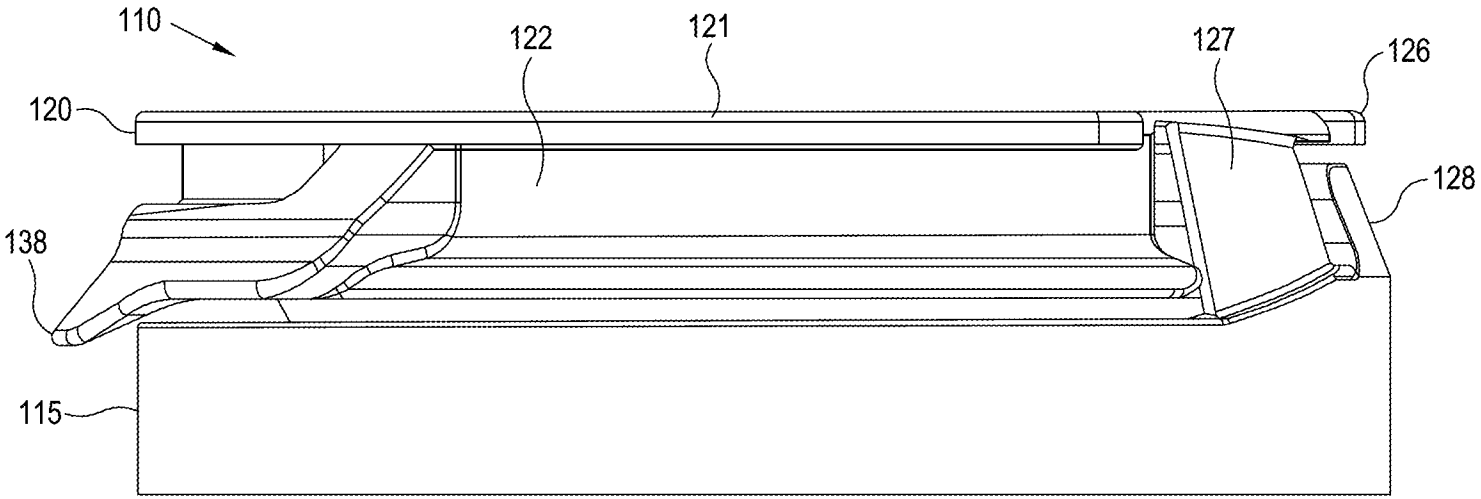
FIG. 8 shows a side view of the closure of FIG. 6.
Figure 9:
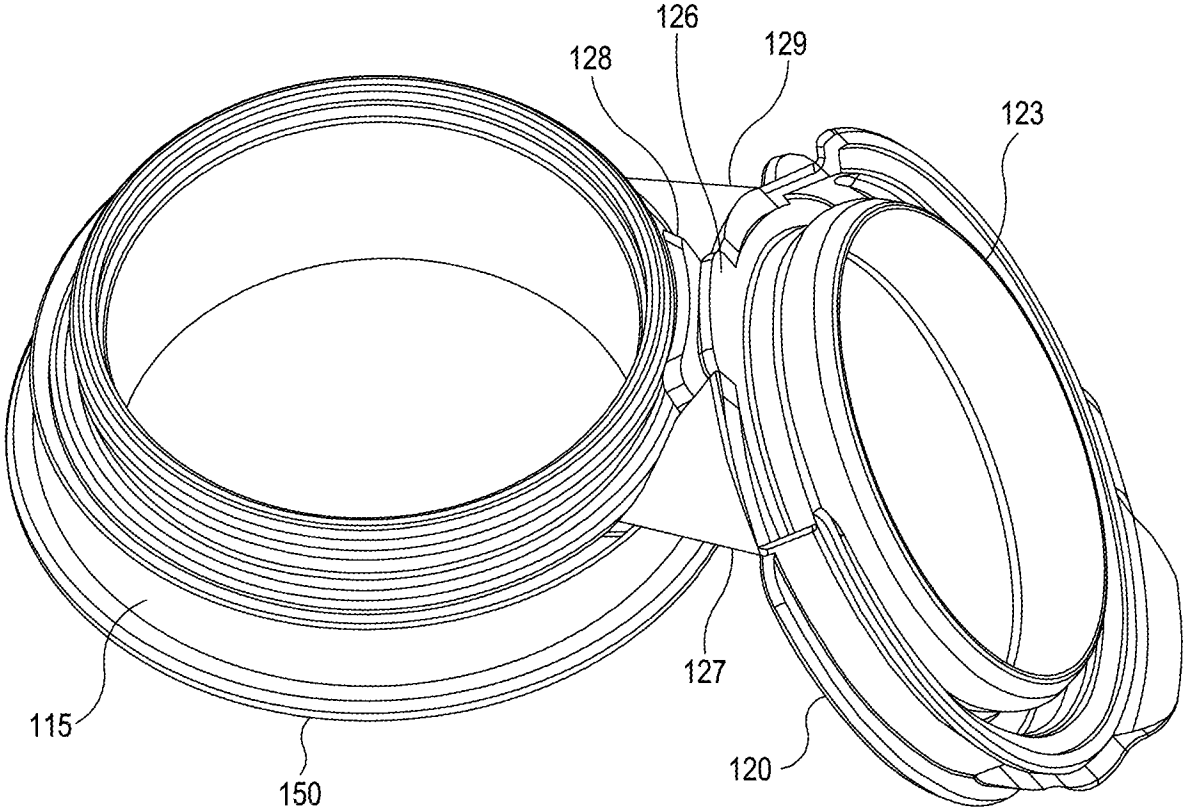
FIG. 9 shows the closure of FIG. 6 in an as-moulded position.
Figure 10:
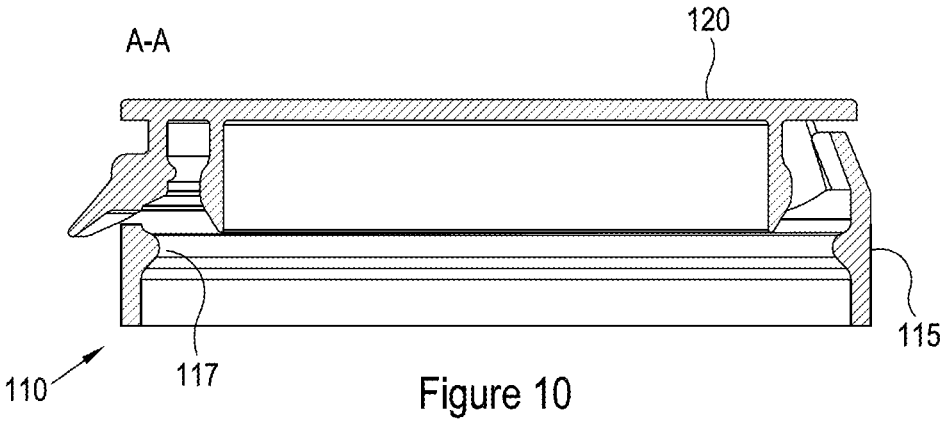
FIG. 10 is a section of the closure of FIG. 11 taken along line A-A.
Figure 11:
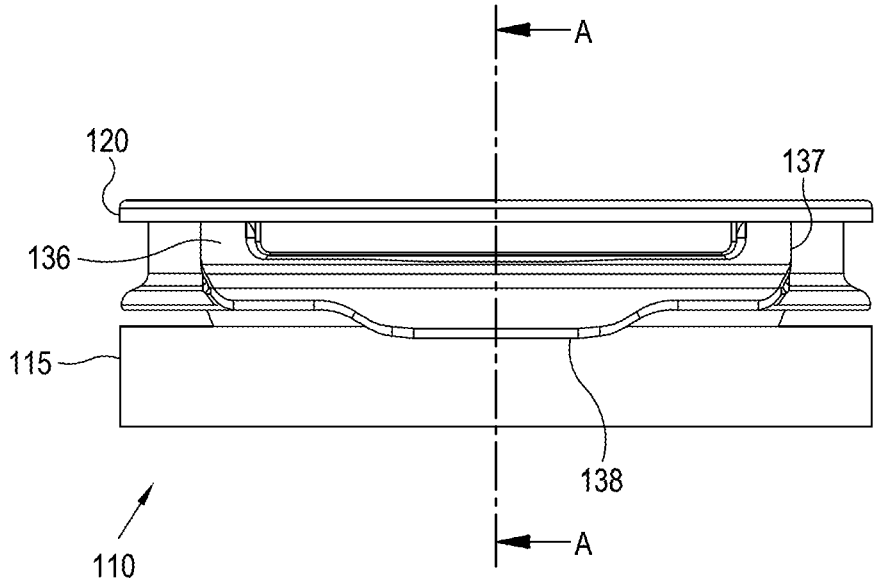
FIG. 11 is a front view of the closure of FIG. 6.
Figure 12:
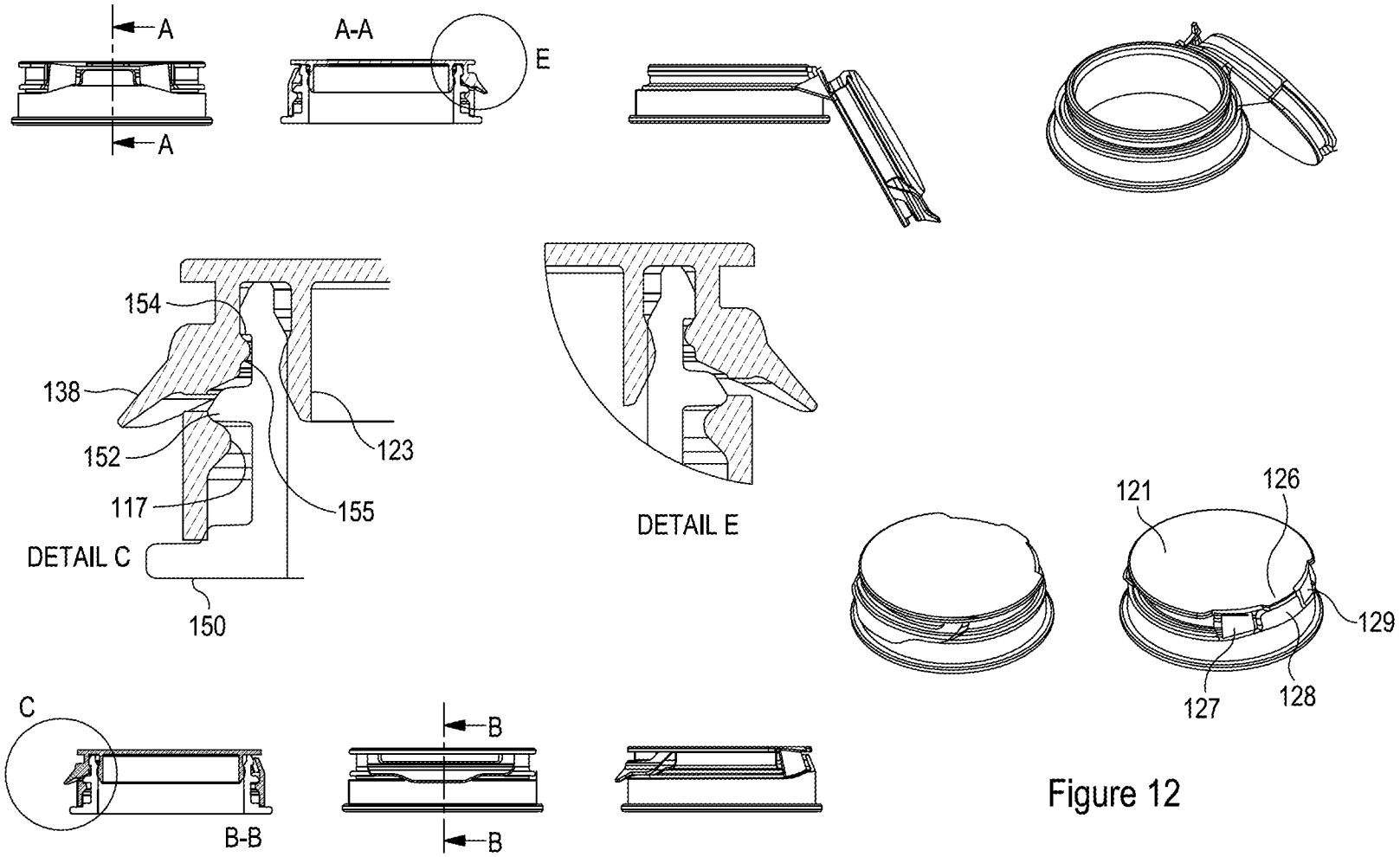
FIG. 12 shows various external and sectional views of the closure of FIGS. 6 to 11.

The present invention will now be more particularly described, by way of example, with reference to the accompanying drawings.

The example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiment can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

In the following description, all orientational terms, such as upper, lower, radially and axially, are used in relation to the drawings and should not be interpreted as limiting on the invention.

Referring first to FIGS. 1 to 5 there is shown a one-piece, tamper-evident closure generally indicated 10.

The closure 10 comprises a generally annular base 15 and a disc-like lid 20.

The base 15 is non-detachably attachable to a container neck 50. The interior of the base 15 includes a generally annular retention (snap) bead 17 which engages under a corresponding bead 52 on the neck finish.

The base 15 and lid 20 are connected by a hinge arrangement 25. The hinge 25 comprises a pair of generally trapezoidal/truncated triangular flanking links 27, 29. Between the links 27, 29 is a central link 30 which comprises a pair of projections 32, 34. When the lid is opened the projections 32, 34 wedge/abut against each other to hold the lid in a stable open position.

The lid 20 includes a generally disc-shape top plate 21 and a sidewall 22 which depends from the top plate, slightly inboard of its periphery (so that it resembles an upturned top hat). An annular plug 23 depends from the underside of the top plate 21 and in use seals in the bore of the container neck.

The sidewall 22 extends from the hinge links 27, 29 around towards the "front" of the lid, opposite the hinge 25. Between the two ends of the sidewall a lifting strap 35 is provided.

The strap 35 is a generally hyoid shape, with two axial strap portions 36, 37 and a central bight 38. The strap 35 has a central gap/aperture/window 39.

In the unopened condition (see FIG. 1, for example) a tamper-evident tab 40 is frangibly connected to the lid sidewall within the window 39 by frangible bridges 42.

The base 15 is provided with a retaining ledge 18. The ledge 18 is positioned so that the "top" of the bight 38 engages thereunder when the lid is closed.

The tamper-evident tab 40 includes a hook 41 which engages under a corresponding hook 19 on the ledge 18.

In use, when the lid is opened for the first time the lifting strap 35 is lifted (using the bight 38, the centre of which is formed like a jutting chin). The tab 40 cannot move upwards because of the hooks 41, 19, so this causes the bridges 42 to break. The tab 40 falls down and therefore fall out of the window (see FIG. 2, for example). This provides visual evidence that the lid has been opened at least once.

FIGS. 6 to 12 show a closure 110 formed according to a further aspect of the present invention. The closure 110 is formed as a one-piece, non-detachable snap-on closure.

The closure 110 comprises a generally annular base 115 and a disc-like lid 120.

The base 115 is non-detachably attachable to a container neck 150. The interior of the base 115 includes a generally annular retention (snap) bead 117 which engages under a corresponding bead 152 on the neck finish.

The base 115 and lid 120 are connected by a hinge arrangement 125. The hinge 125 comprises a pair of generally trapezoidal/truncated triangular flanking links 127, 129 which connect to the base and the lid.

Between the links 127, 129 the top plate 121 of the lid is provided with a tab extension 126 and the base is provided with a corresponding upstanding tab extension 128. When the lid is opened the extensions 126, 128 wedge/abut against each other to hold the lid in a stable open position (see FIGS. 7 and 9, for example).

The lid 120 includes a generally disc-shape top plate 121 and a sidewall 122 which depends from the top plate, slightly inboard of its periphery (so that it resembles an upturned top hat). An annular plug 123 depends from the underside of the top plate 121 and in use seals in the bore of the container neck.

Opposite the hinge 125 a lifting strap 135 is provided. The strap 135 is a generally hyoid shape, with two axial strap portions 136, 137 and a central bight 138.

The interior of the bight 138 is provided with a bead 155 which engages under the container neck rim 154. This engagement provides a strong retention force, preventing the lid from being accidentally lifted.

Figure 13:
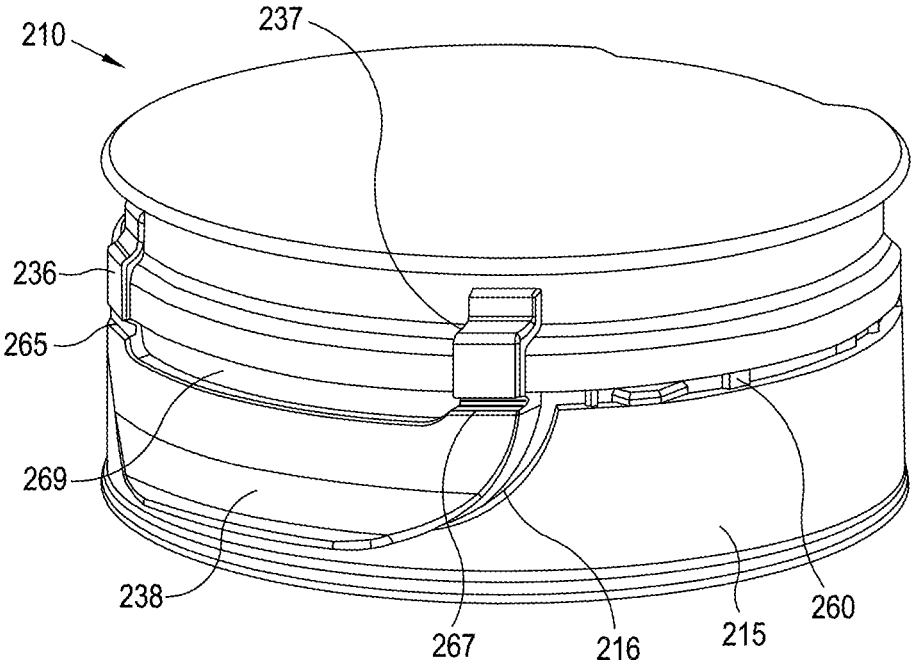
FIG. 13 shows a one-piece, non-detachable snap-on closure in a before opening position.
Figure 14:
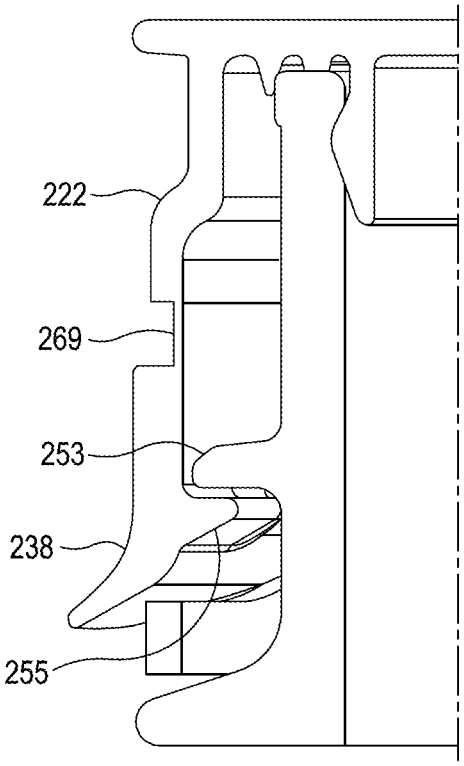
FIG. 14 shows a section of the closure of FIG. 13.
Figure 15:
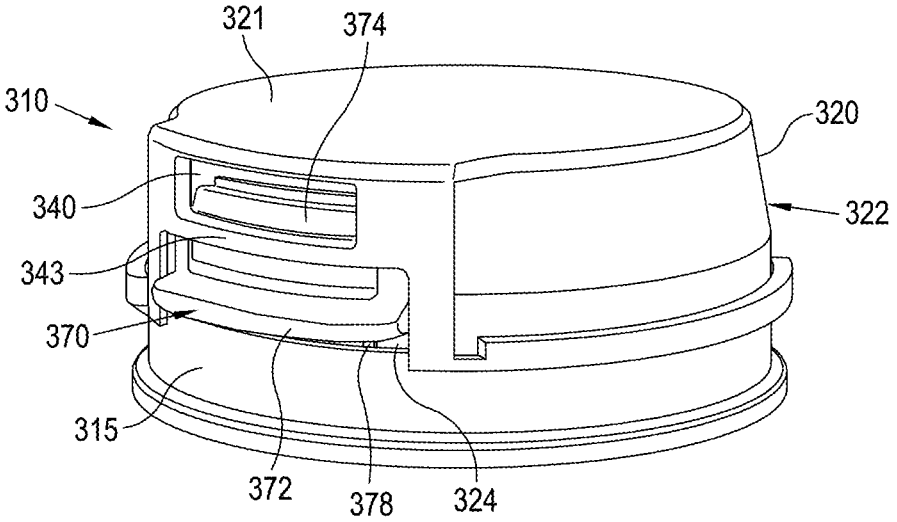
FIG. 15 shows a tamper-evident closure in a before opening position.
Figure 16:
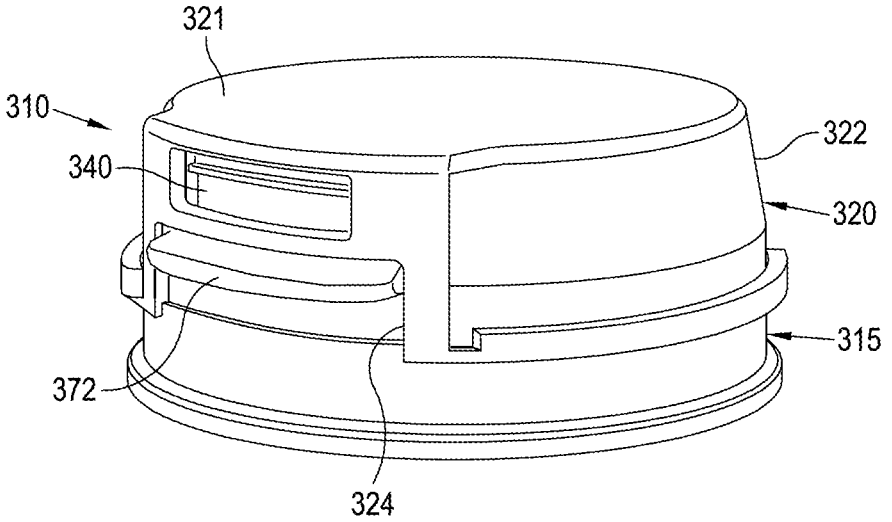
FIG. 16 shows the closure of FIG. 15 in a reclosed position.
Figure 17:
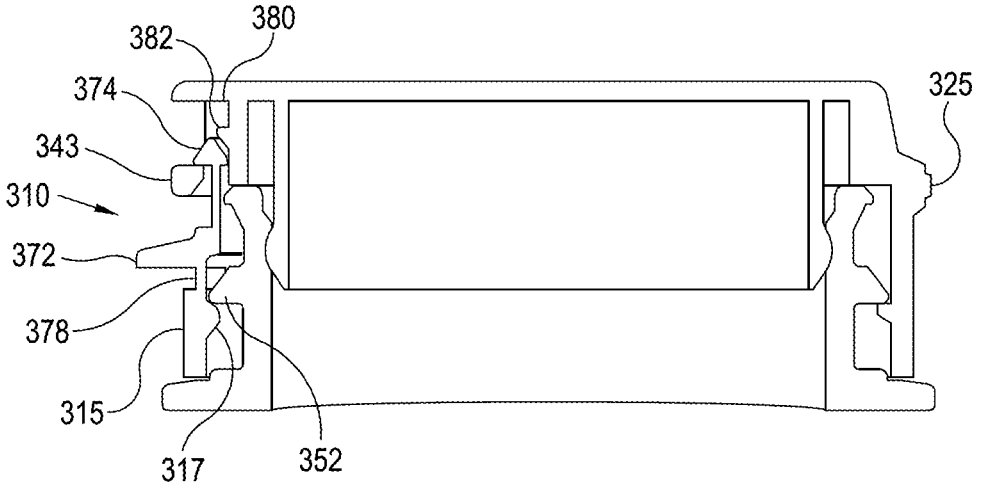
FIG. 17 is a section of the closure of FIG. 15.
Figure 18:
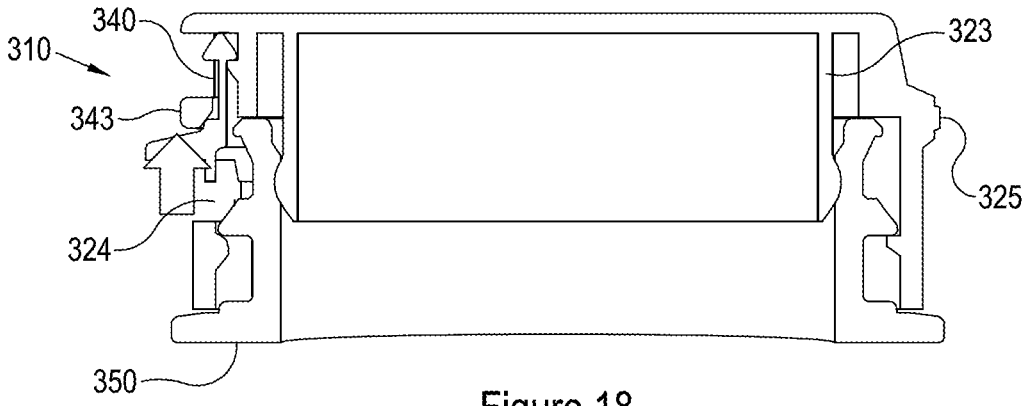
FIG. 18 is a section of FIG. 16 and illustrating opening of the closure.
Figure 19:
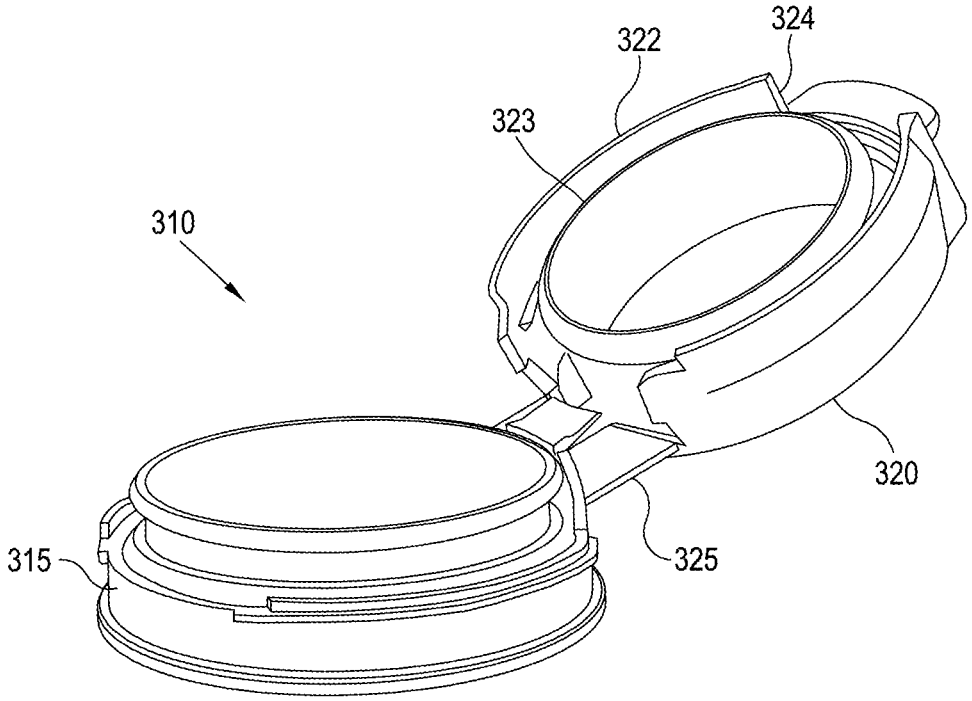
FIG. 19 shows the closure of FIGS. 15 to 18 in an opened position.
Figure 20:
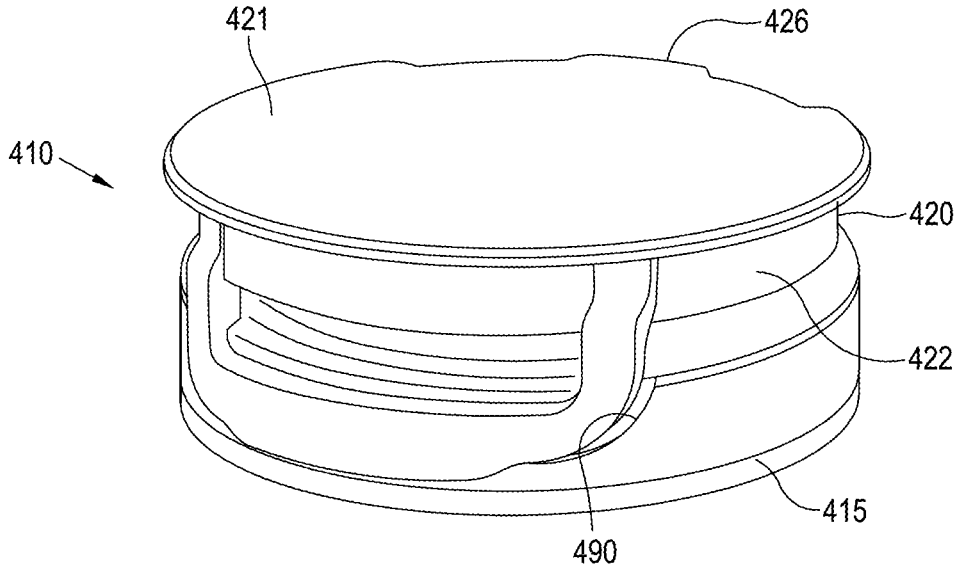
FIG. 20 shows a closure in a before opening position.
Figure 21:
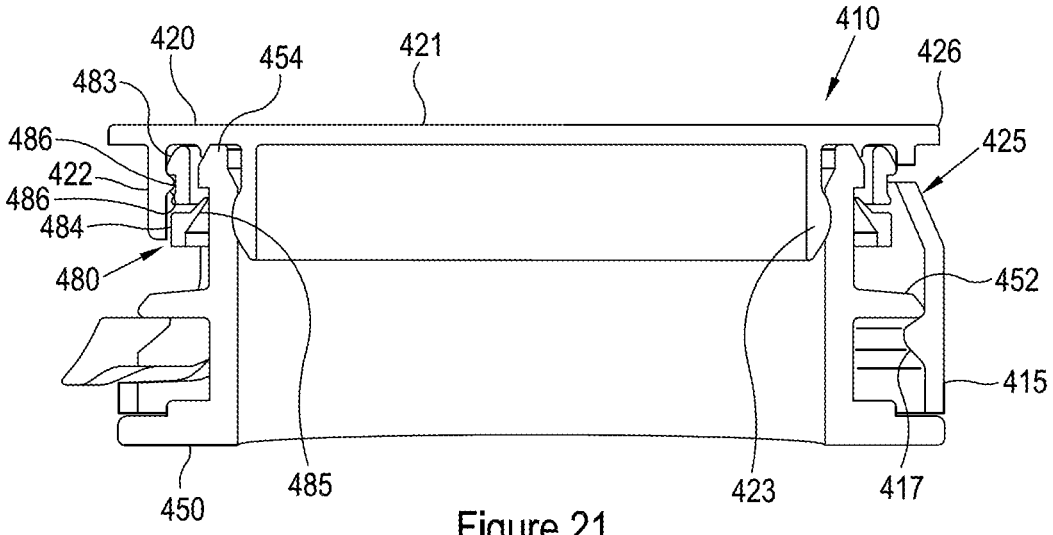
FIG. 21 shows a section of the closure of FIG. 20.
Figure 22:
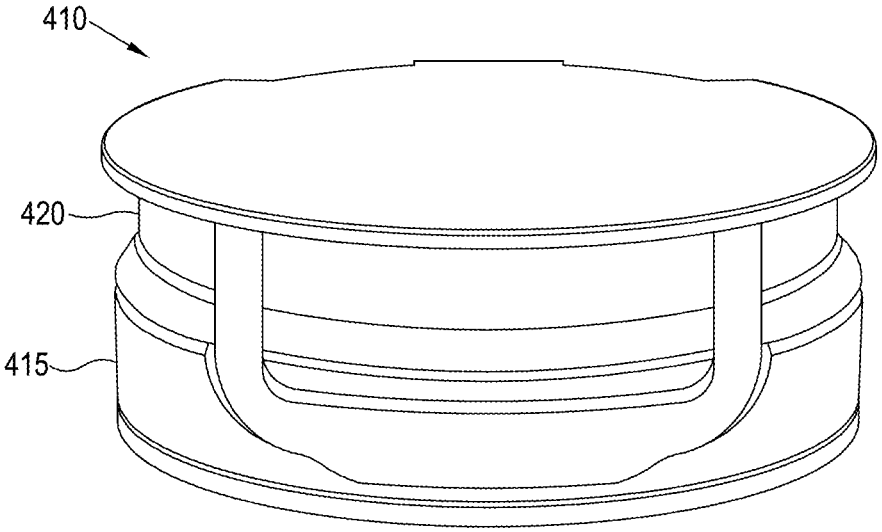
FIG. 22 shows the closure of FIG. 15 in a reclosed position.
Figure 23:
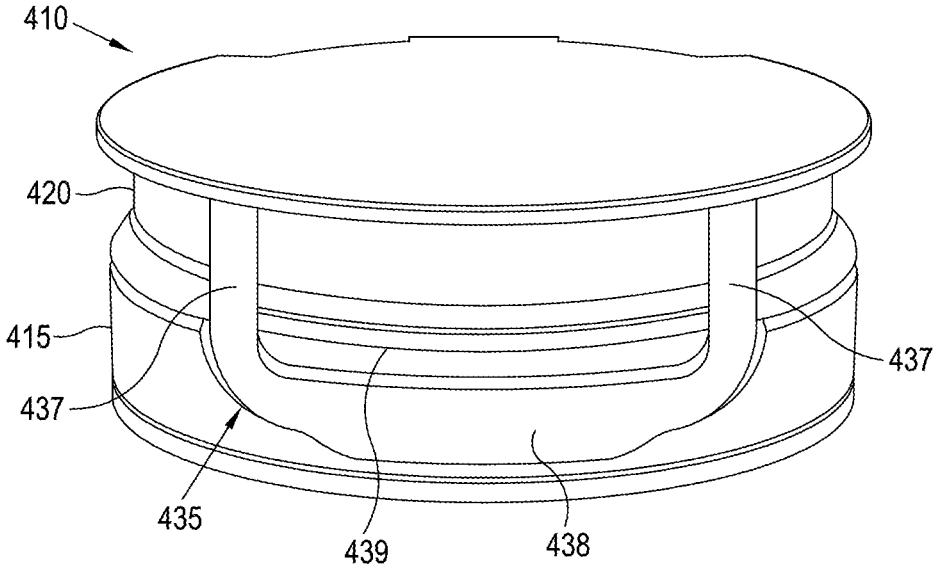
FIG. 23 shows a front view of the closure of FIG. 15.
Figure 24:
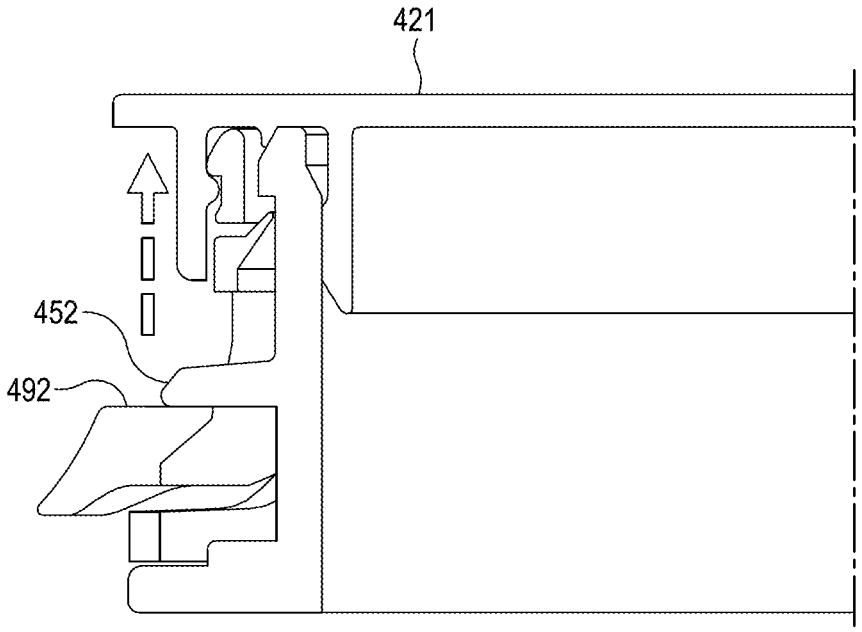
FIG. 24 is a section of the closure of FIG. 15 illustrating a direction of movement of a lifting member.

FIGS. 13 and 14 show a closure 210 formed according to a further embodiment. The closure 210 is similar to the closure 110.

In this embodiment the base 215 includes a frontal cut-out 216 in which a strap bight 238 sits. This means that a bight retaining projection 255 can engage under a neck bead 253 (rather than under the rim) to hold the lid closed. In this embodiment, at the split line between the base and the lid they are joined by a plurality of frangible bridges 260.

The bight 238 is joined to the straps 236, 237 by thinned lines 265, 267 and the bight is joined to the lid sidewall 222 by a thinned line 269. This means that the bight 238 can be hinged outwards to allow the projection 255 to pass over the bead 253.

FIGS. 15 to 19 show a tamper-evident closure 310 formed according to a further aspect of the present invention.

The closure 310 comprises a base 315 and a lid 320. The base and lid are connected by a hinge 325.

The base 315 is generally annular and is non-detachably attachable to a container neck 350. The interior of the base 315 includes a generally annular retention (snap) bead 317 which engages under a corresponding bead 352 on the neck finish.

The lid 320 comprises a disc-shape top plate 321 and a sidewall 322 that depends from the periphery thereof.

At the "front" of the lid 320, generally opposite the hinge 325, the sidewall 322 includes a cut-out 324 that extends from the free end of the sidewall. Axially above (i.e. closer to the top plate 321) the sidewall includes a window 340. The cut-out 324 and window 340 are separated by a bar 343.

A tamper-evident lifting member 370 is provided. The member 370 comprises a lower peak 372 and an upper hook 374 joined together by an intermediate portion 376. In the unopened condition the peak 372 is frangibly connected to the base by frangible bridges 378. The lid sidewall includes a recessed portion 380 which has a hook 382. In this embodiment the portion 380 sits on top of the neck rim 384. In the unopened condition the upper hook 374 sits above the bar 343 and below the hook 382 and is visible in the window 340.

In use, the lid is opened by lifting the member 370 using the peak 372. This causes the bridges 378 to break and the member moves axially towards the top plate 321. The member hook 374 moves over and engages above the sidewall hook 382, which prevents it from moving back down. Continued lifting of the member 370 now lifts the lid. The position of the member 370 with respect to the cut-out 324 and the window 340 provides visual evidence of opening of the lid.

FIGS. 20 to 30 show a closure 410 formed in accordance with a further aspect of the present invention.

The closure 410 comprises a generally annular base 415 and a disc-like lid 420.

The base 415 is non-detachably attachable to a container neck 450. The interior of part of the base 415 includes a generally annular retention (snap) bead 417 which engages under a corresponding bead 452 on the neck finish.

The lid 420 includes a generally disc-shape top plate 421 and a sidewall 422 which depends from the top plate, slightly inboard of its periphery (so that it resembles an upturned top hat). An annular plug 423 depends from the underside of the top plate 421 and in use seals in the bore of the container neck.

The base 415 and lid 420 are connected by a hinge arrangement 425. The hinge 425 comprises a pair of generally trapezoidal/truncated triangular flanking links 427, 429 which connect to the base and the lid.

Between the links 427, 429 the top plate 421 of the lid is provided with a tab extension 426 and the base is provided with a corresponding upstanding tab extension 428. When the lid is opened the extensions 426, 428 wedge/abut against each other to hold the lid in a stable open position (see FIGS. 29 and 30, for example).

The sidewall 422 extends from the hinge links 427, 429 around to the "front" of the lid, opposite the hinge 425. A lifting strap 435 is provided. The strap 435 is a generally hyoid shape, with two axial strap portions 436, 437 and a central bight 438. The strap 435 defines a gap/aperture/window 439. The upper surface of the bight 438 is flat and engages under the neck bead 453. The base includes a frontal cut-out 490 that is shaped to correspond with the bight 438.

A tamper-evident member 480 is provided. The member 480 comprises a double ring structure, with an upper 482 and lower 484 ring which are frangibly connected together. The upper ring 482 has a hook 483 which extends radially outwards. The lower ring 484 has a hook 485 which extends radially inwards. The lid sidewall includes a retention bead 486. The upper ring hook 483 engages over the bead 486 to retain the ring 482. The lower ring hook 485 engages under the neck rim 454.

Figure 25:
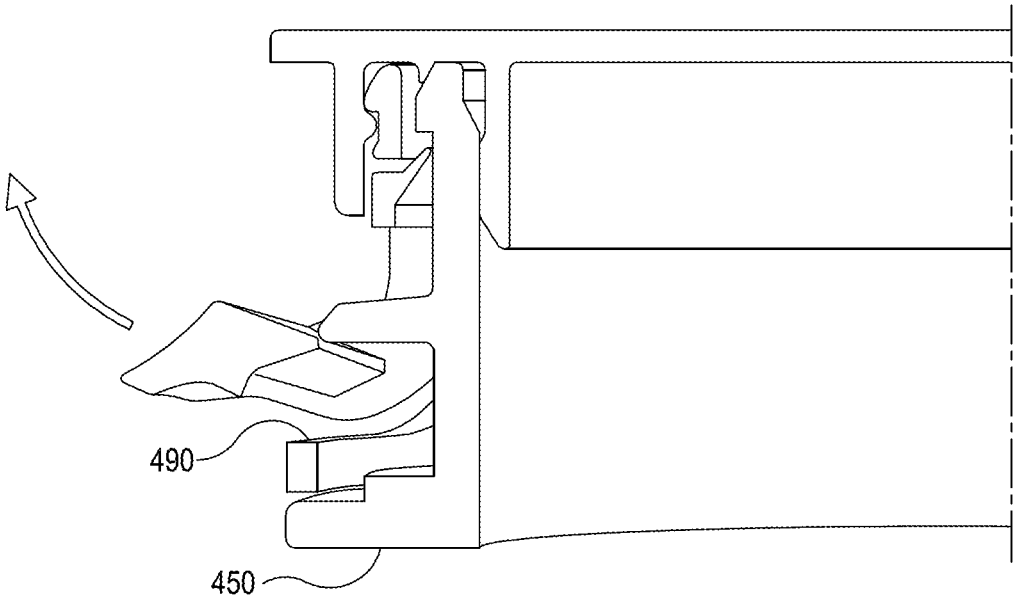
FIG. 25 shows the lifting member of FIG. 24 being lifted over a container bead.
Figure 26:
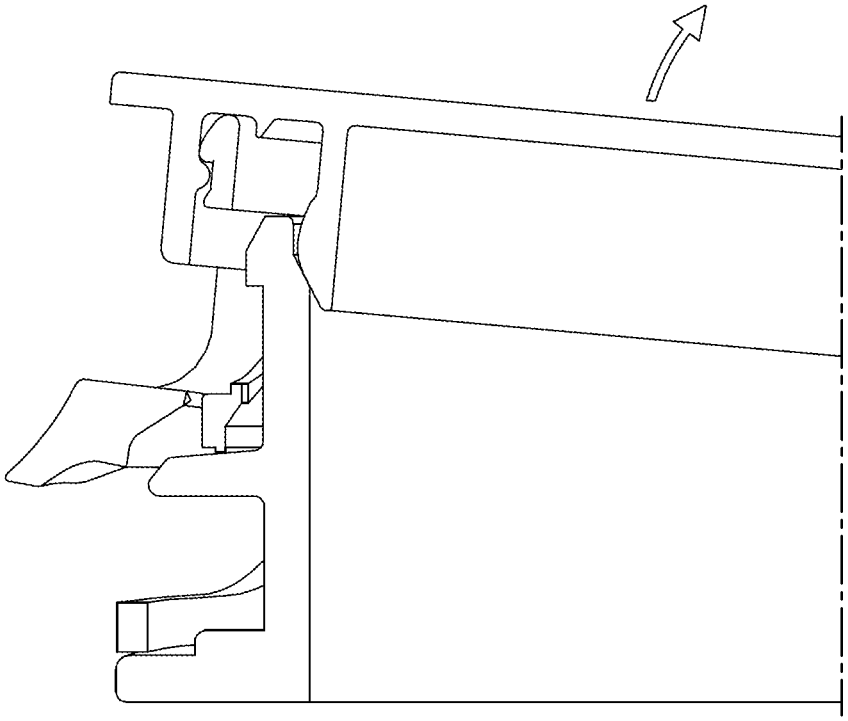
FIG. 26 shows the lifting member of FIG. 25 after lifting over the container bead.
Figure 29:
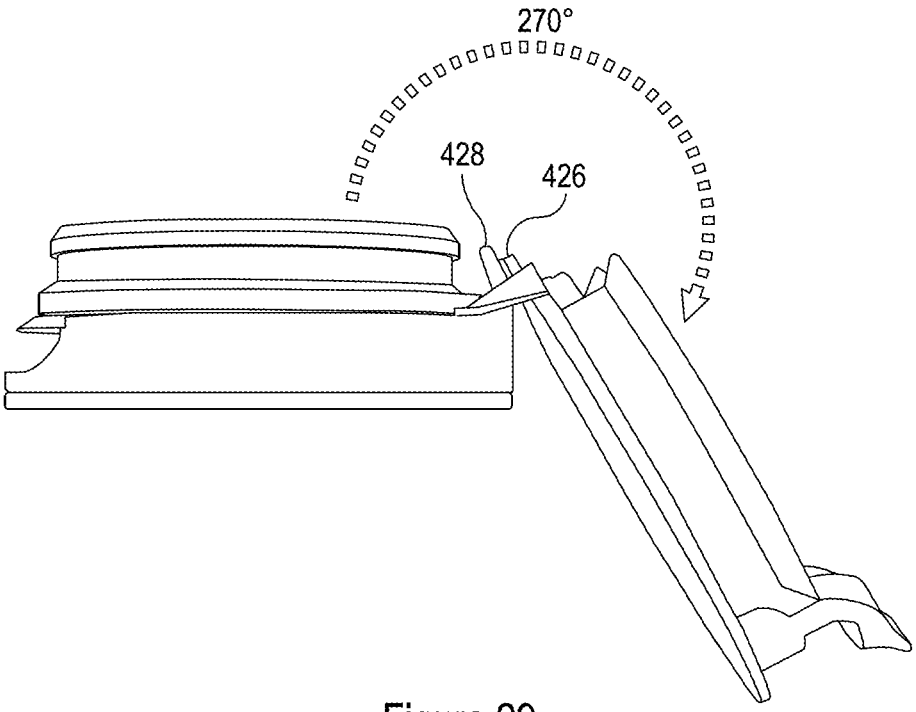
FIG. 29 shows the closure of FIG. 29 in a fully opened position.
Figure 30:
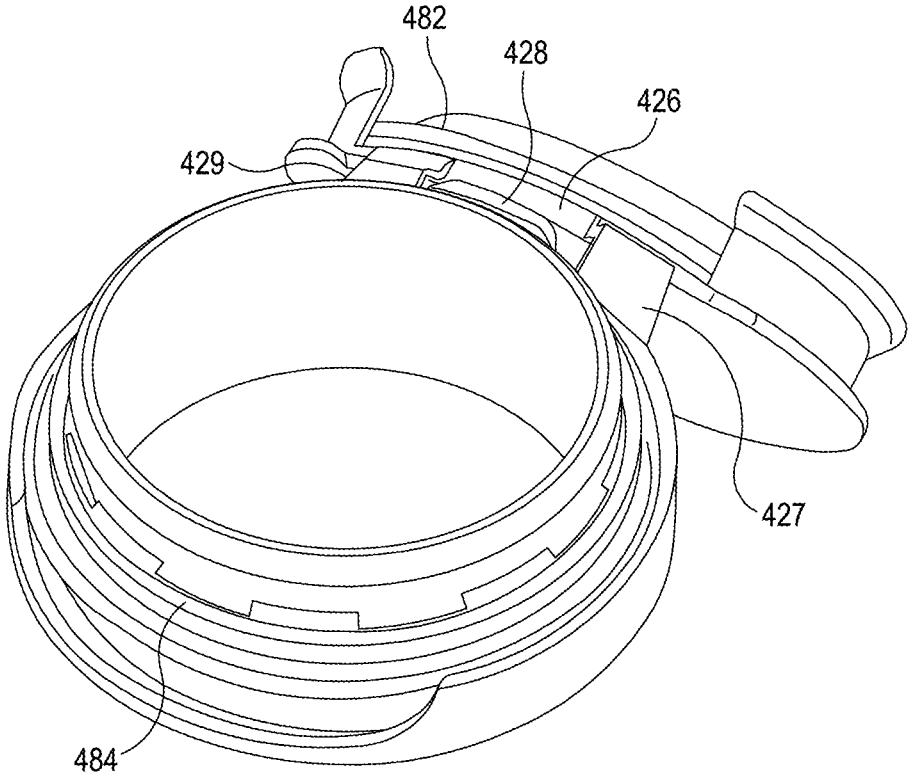
FIG. 30 shows a front perspective view of the closure of FIG. 29.
Figure 31:
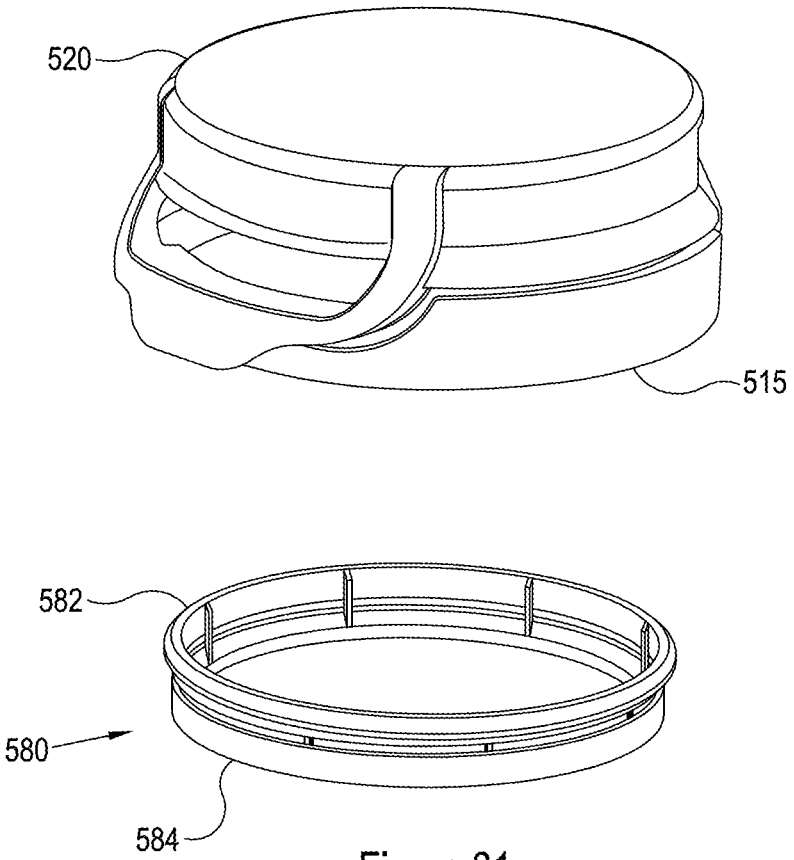
FIG. 31 is an exploded view of a tamper-evident closure.

The closure is shown unopened in FIGS. 20, 21, 23 and 24. The lid cannot be lifted because of the engagement of the flat upper face 492 of the bight under the bead 452. In order to open the lid the strap 435 must be bent/pivoted from under the bead, as illustrated in FIG. 25. This causes the rings 482, 484 to be broken apart (FIG. 26). The lid can be pivoted over, in this embodiment by 270 degrees (FIGS. 29 and 30). The tabs 426, 428 engages to provide a stable open position.

Figure 27:
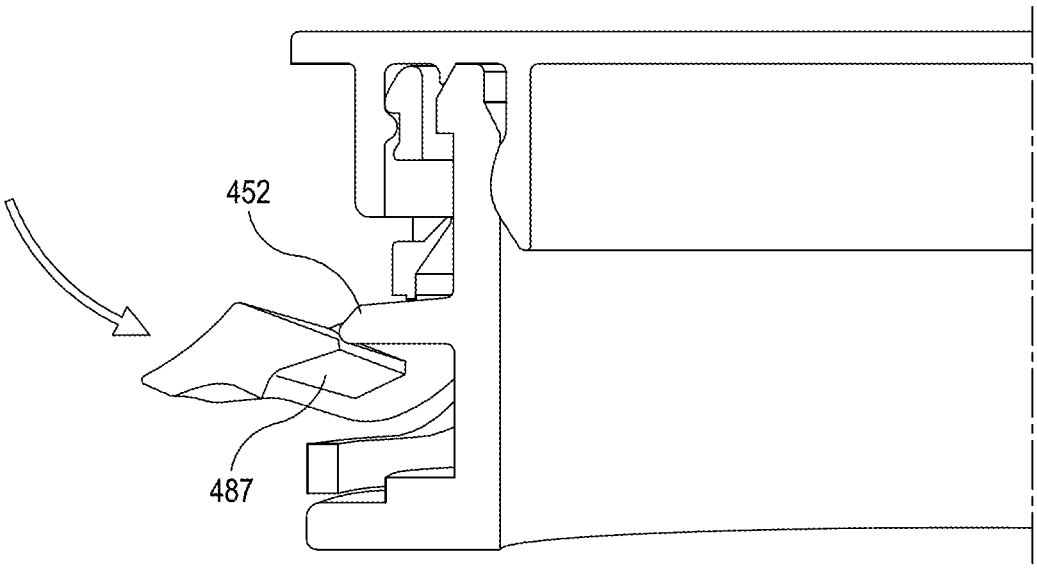
FIG. 27 shows the closure of FIG. 26 during reclosure.
Figure 28:
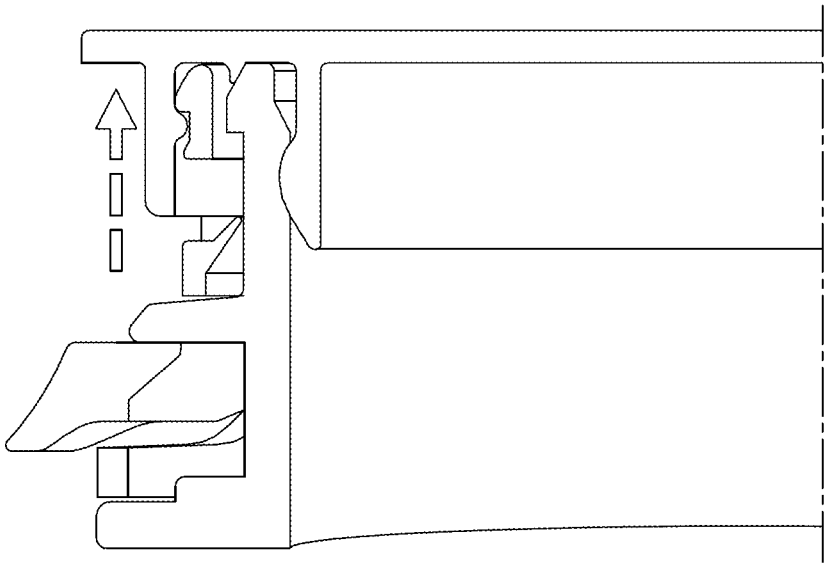
FIG. 28 shows the closure of FIG. 27 in a reclosed position.

When the lid is reclosed the inclined face 487 of the bight 483 allows it to pass over the bead 452 (FIG. 27). The upper ring is retained in the lid. The lower ring has dropped down onto the neck bead 452 and is visible through the window 439 (FIGS. 22, 27 and 28) to serve as visual evidence that the lid has been opened.

FIGS. 31 to 39 show a closure 510 formed according to a further embodiment. The closure 510 is similar to the closure 410. In this embodiment the lower ring hook 585 extends radially inwards with a flat upper surface (as opposed to extending radially inwards and upwards towards the top plate as with the hook 485).

Figure 32:
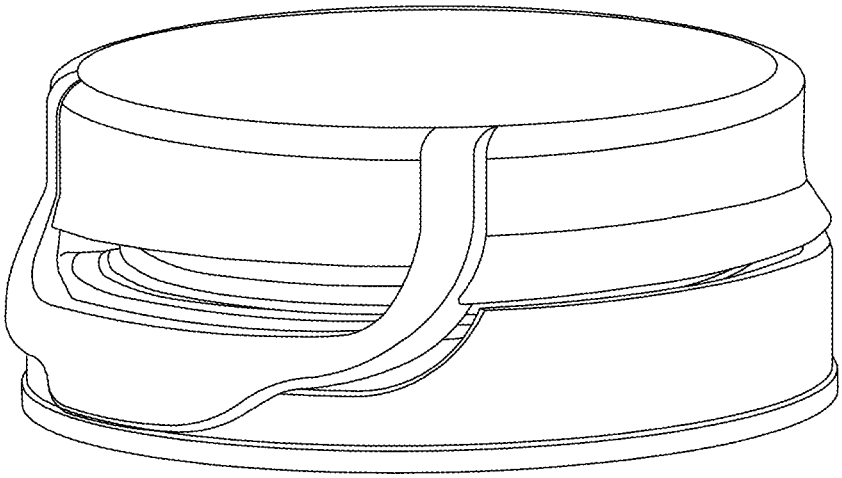
FIGS. 32, 34 and 36 show the closure of FIG. 31 assembled and unopened.
Figure 33:
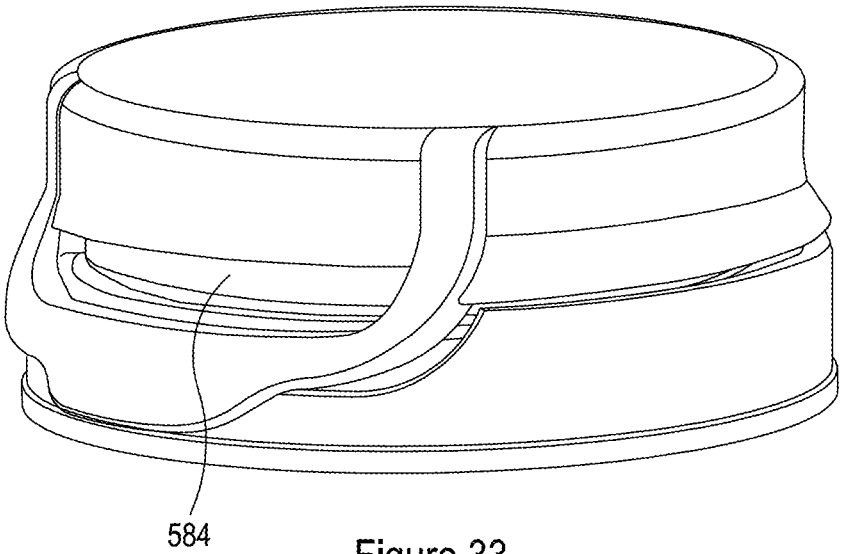
FIGS. 33, 35 and 37 show the closure following reclosing of the closure of FIGS. 32, 34 and 36.
Figure 34:
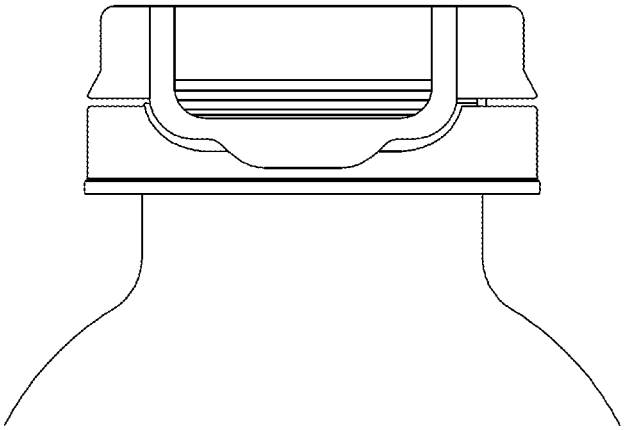
Figure 35:
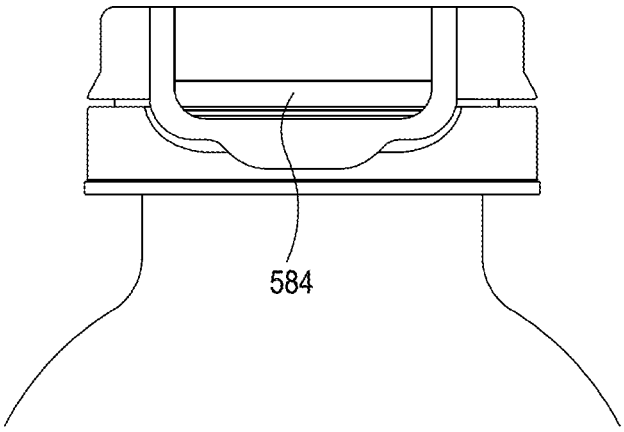
Figure 36:
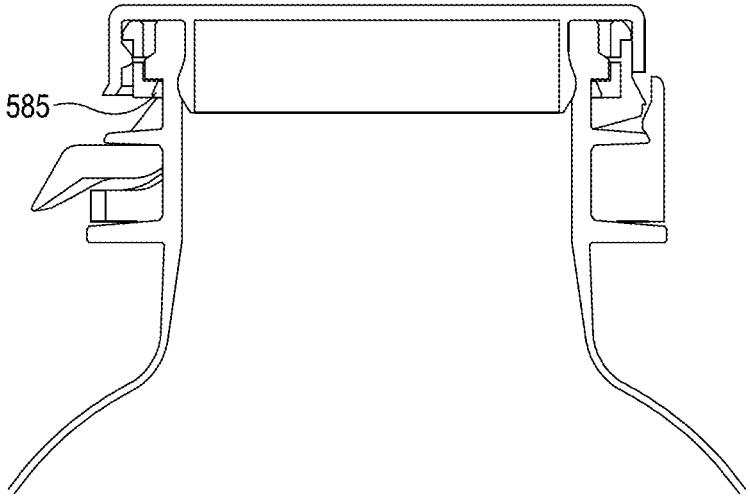
Figure 37:
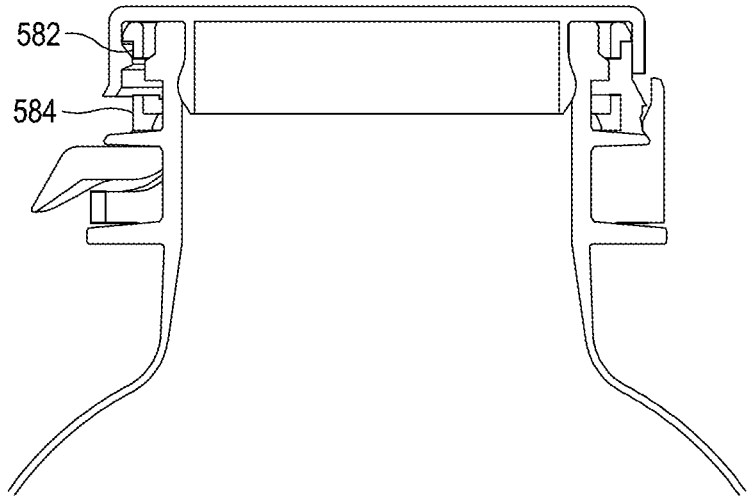

FIGS. 32, 34 and 36 show the closure unopened. FIGS. 33, 35 and 37 show the closure following opening. The lower ring 584 has dropped down and is visible through the window 539.

Figure 38:
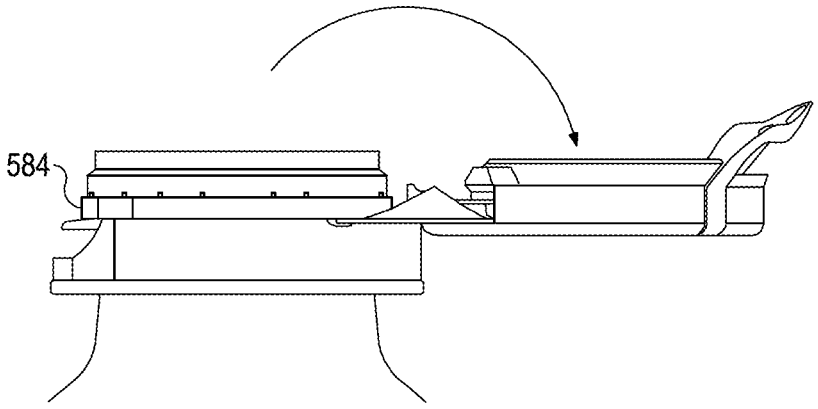
FIGS. 38 and 39 show the closure of FIGS. 32 to 27 in an open position.
Figure 39:
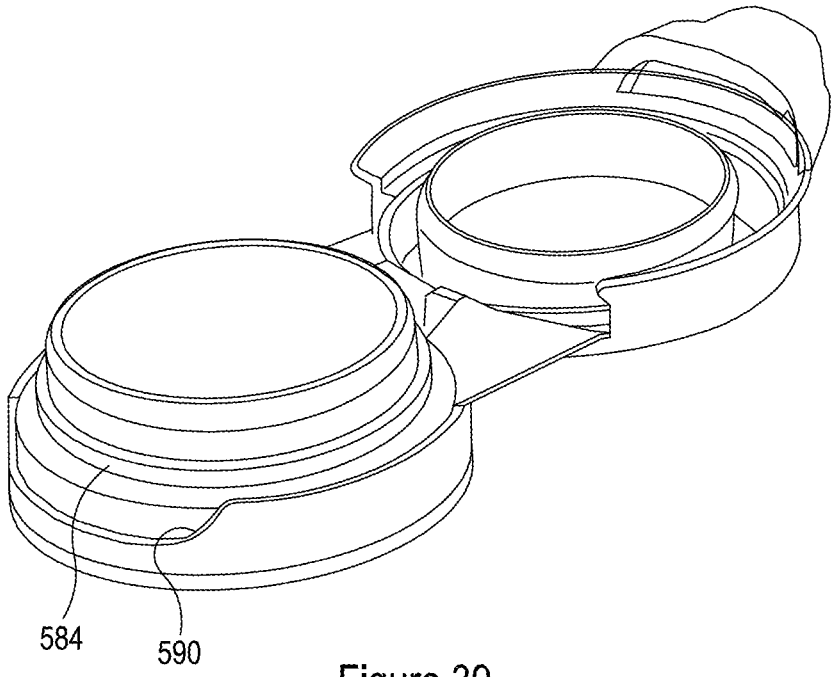
Figure 40:
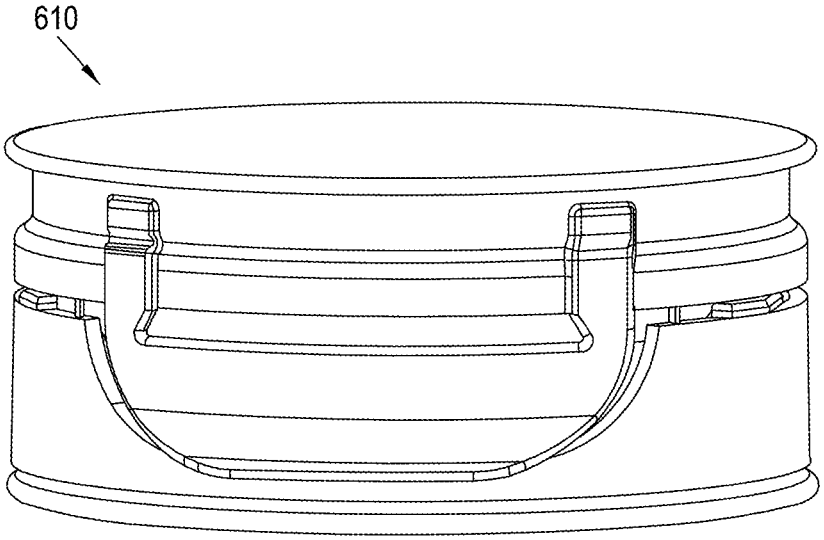
FIG. 40 shows a tamper-evident closure in a before opening position.
Figure 41:
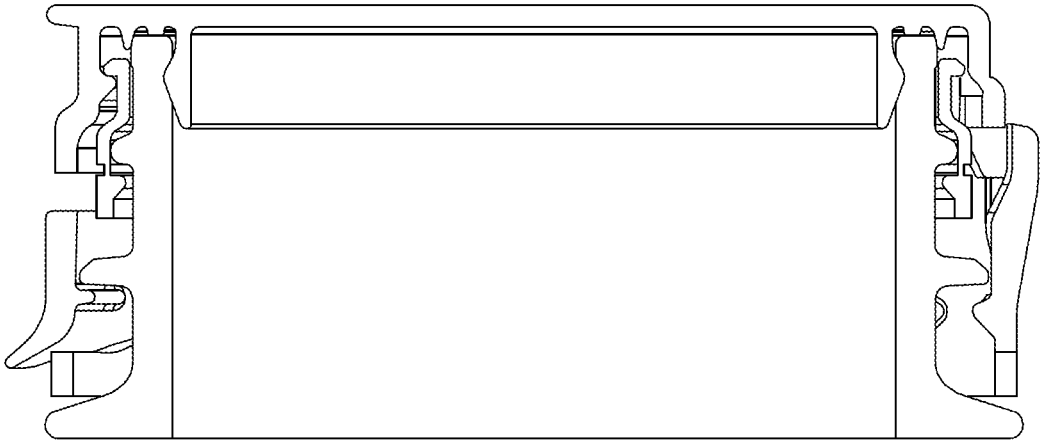
FIG. 41 is a section of the closure of FIG. 40.
Figure 42:
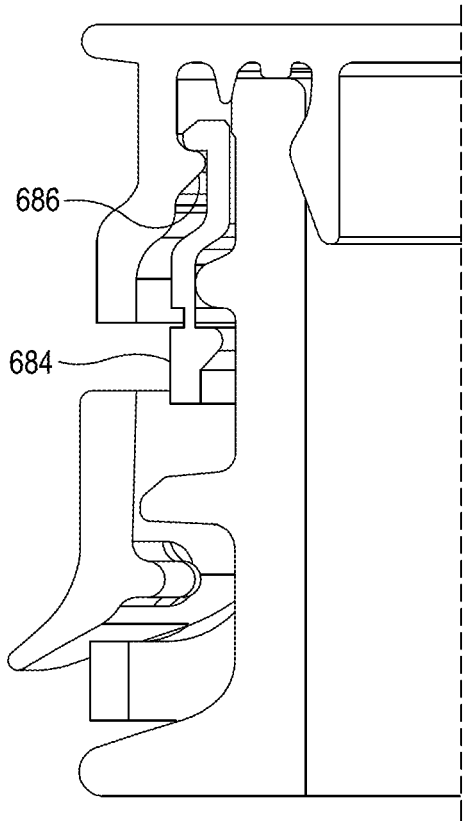
FIG. 42 is magnified view of the section of FIG. 41.
Figure 43:
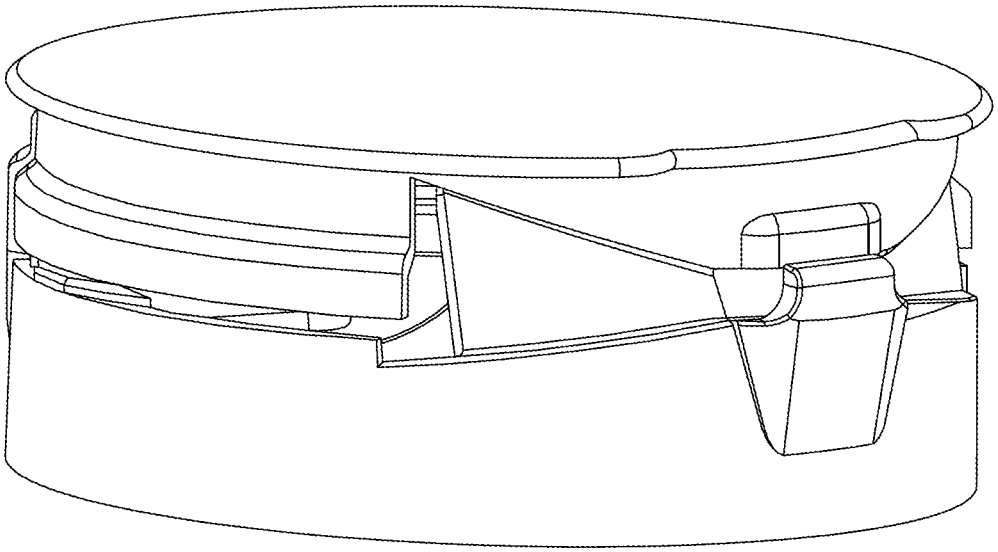
FIG. 43 is a rear perspective view of the closure of FIG. 40.
Figure 44:
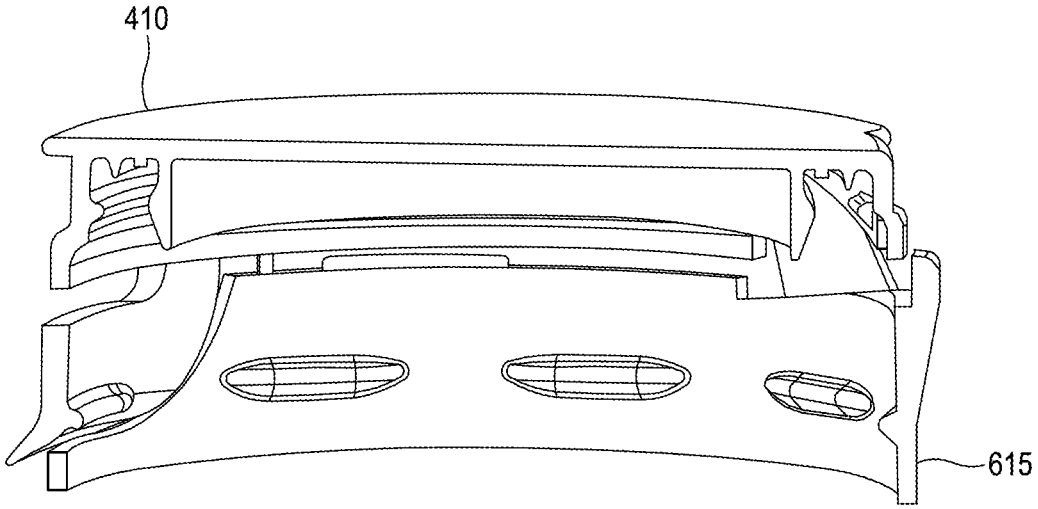
FIG. 44 is a partial section of a body component forming part of the closure of FIG. 40.
Figure 45:
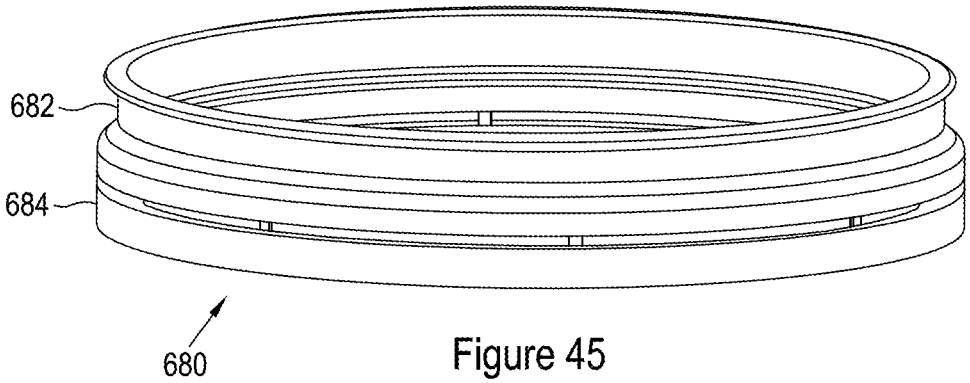
FIG. 45 is a perspective view of a tamper-evident member component forming part of the closure of FIG. 40.

In this embodiment the hinge arrangement provides a stable open position at approximately 180 degrees (FIGS. 38 and 39).

FIGS. 40 to 45 show a closure 610 formed according to a further embodiment. The closure 610 is similar to the closures 410, 510. In this embodiment the lower ring hook 685 extends radially inwards with a flat upper surface. The upper ring is formed with a chicane-like section.

Figure 46:
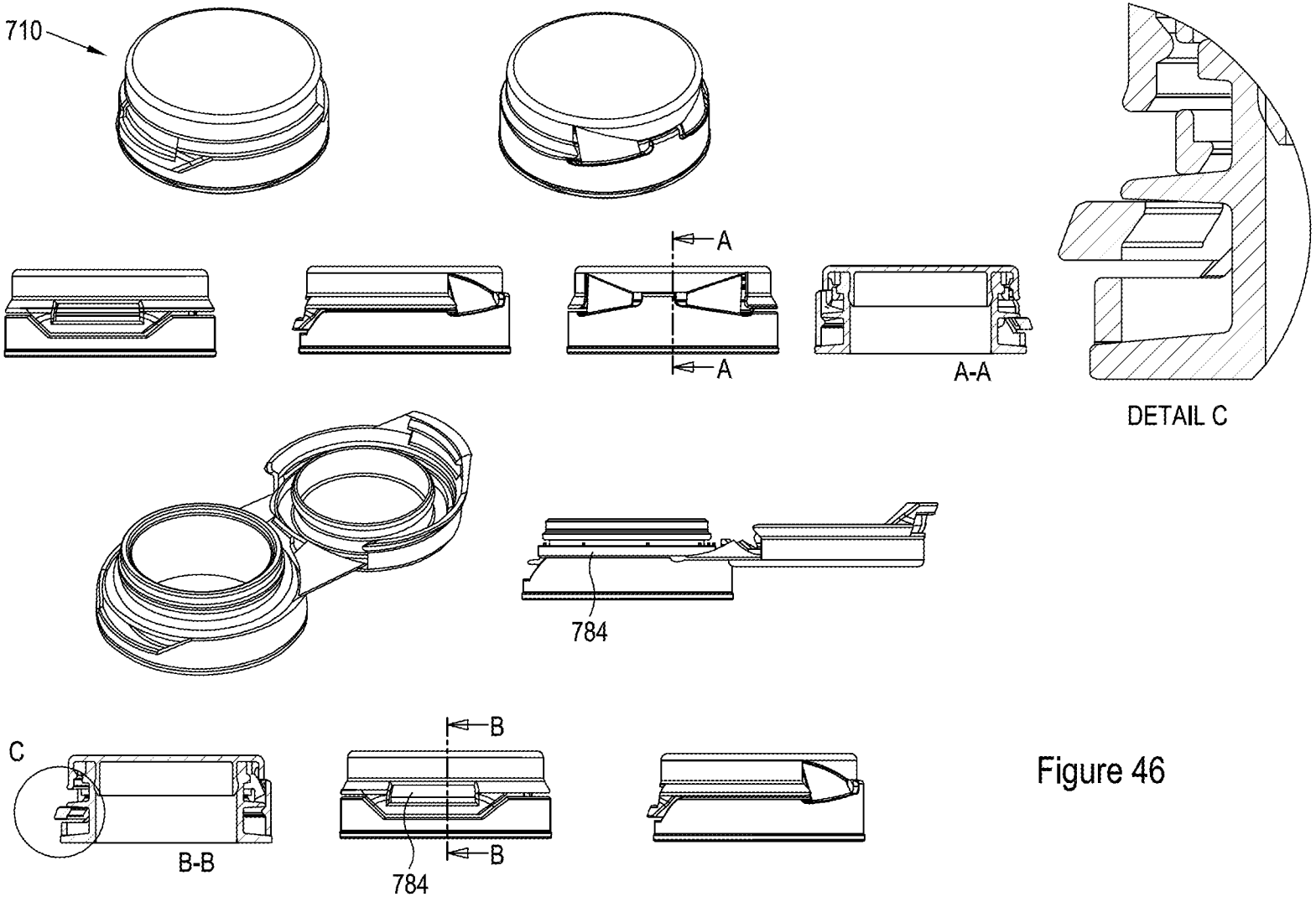
FIG. 46 shows various external and sectional views of a tamper-evident closure.
Figure 47:
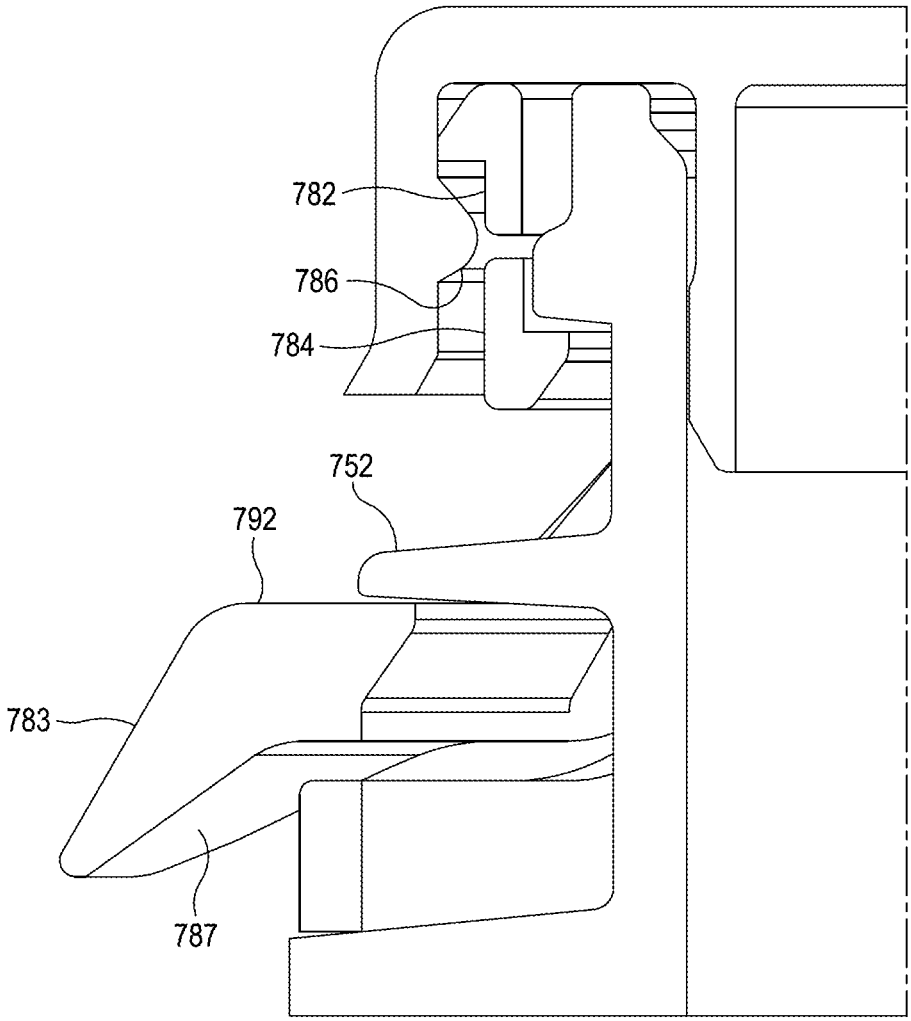
FIG. 47 shows a magnified section of the closure of FIG. 46.
Figure 48:
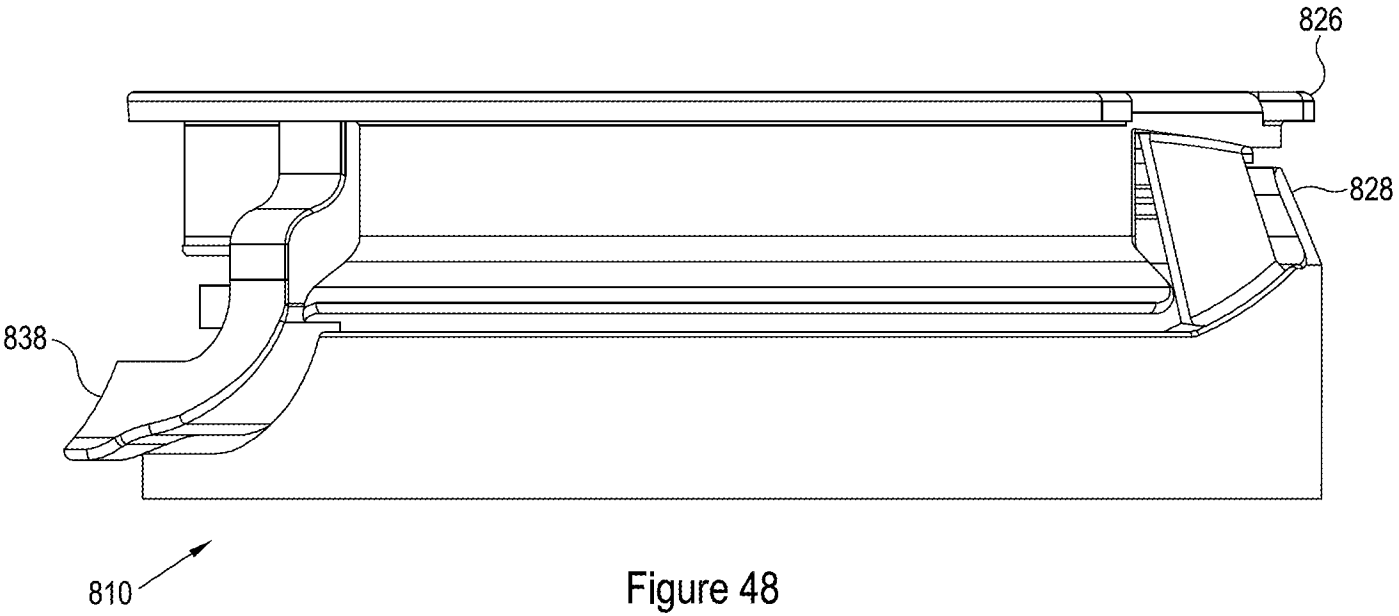
FIG. 48 shows a side view of a tamper-evident closure in a before opening position.
Figure 49:
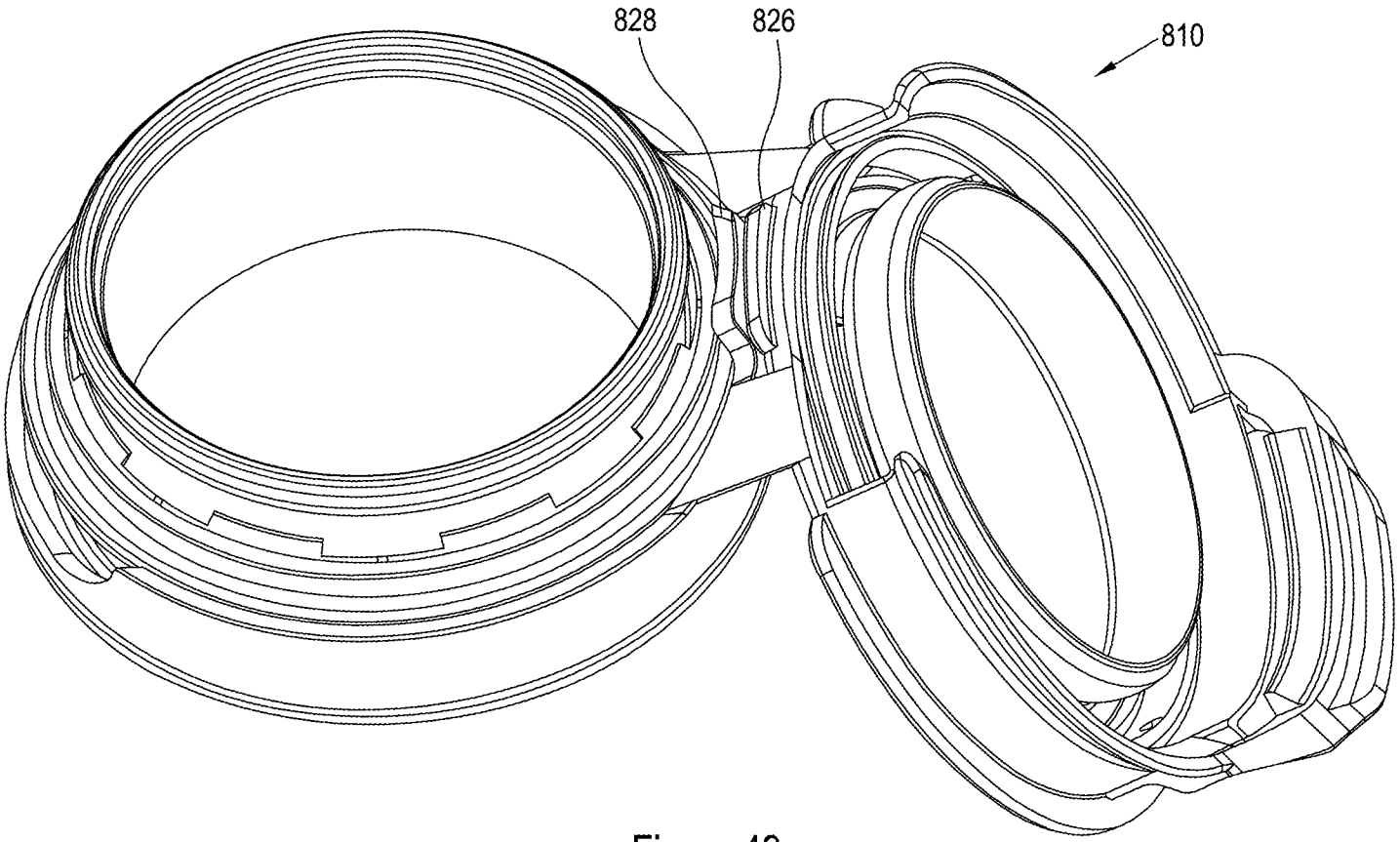
FIG. 49 shows the closure of FIG. 48 in an open position.
Figure 50:
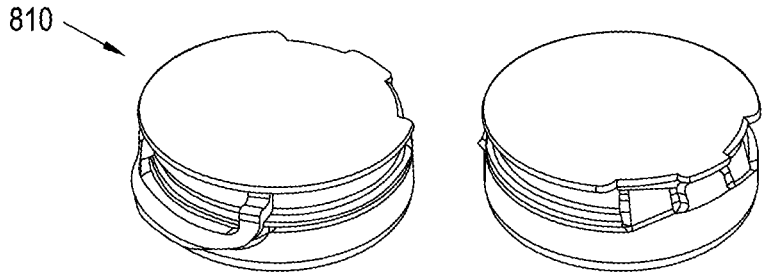
FIG. 50 shows front and rear perspective views of the closure of FIG. 48.
Figure 51:
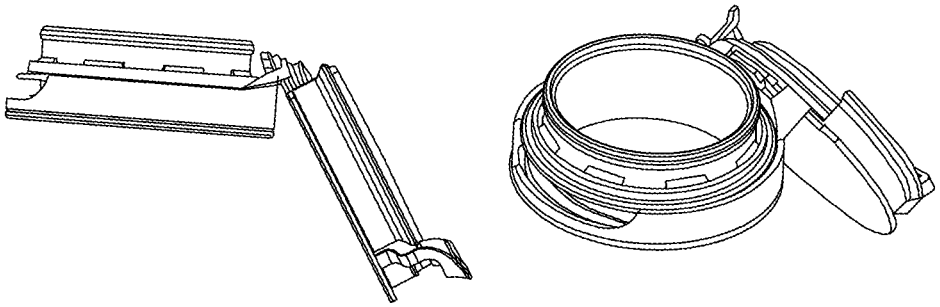
FIG. 51 shows side and front perspective views of the closure of FIG. 49.
Figure 52:
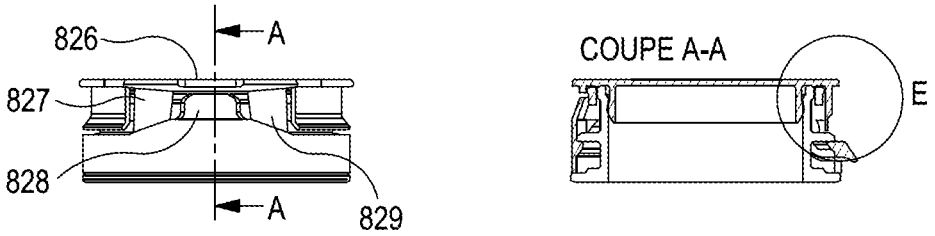
FIG. 52 shows a rear perspective view of the closure of FIG. 48 and a section along line A-A with the closure in a reclosed position.
Figure 53:
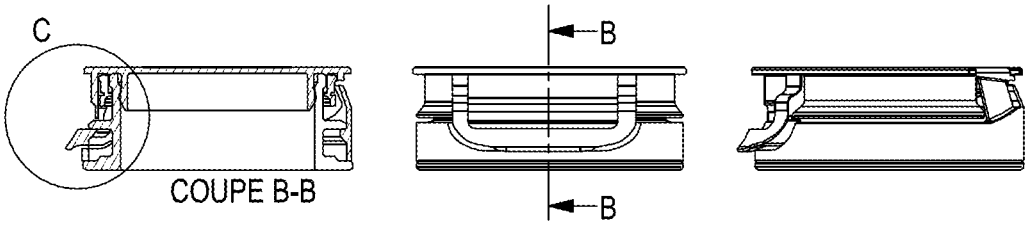
FIG. 53 shows a front and side view of the closure of FIG. 48 and a section along line B-B.
Figure 55:
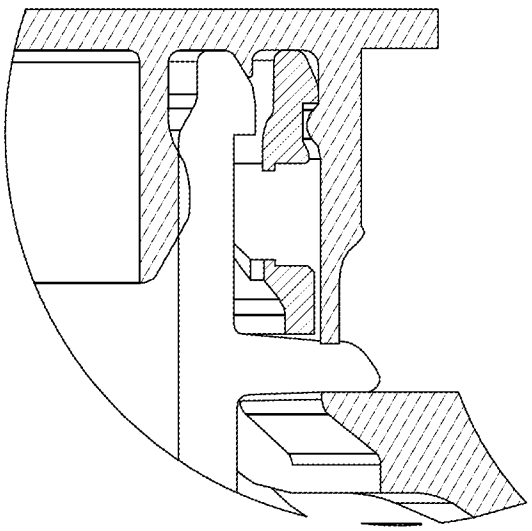
FIG. 55 is a magnified view of Detail E of FIG. 52.
Figure 54:
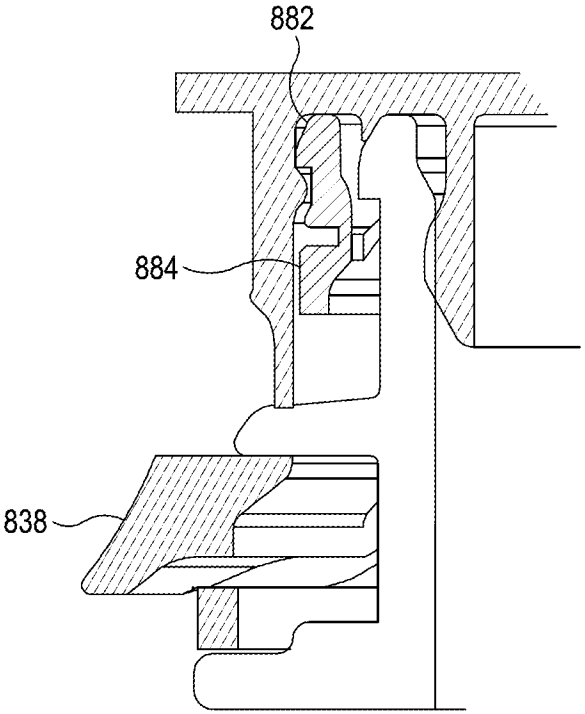
FIG. 54 is a magnified view of Detail C of FIG. 53.

In this embodiment, in the unopened condition the lower ring is visible. Upon first opening the lower ring drops onto the neck bead and is no longer visible, whereby to indicate opening. FIGS. 46 and 47 show a closure 710 formed according to a further embodiment. The closure 710 is similar to the closures 410, 510, 610, with a double ring tamper-evident member. The upper ring 784 drops to become visible upon first opening.

FIGS. 48 to 55 show a closure 810 formed according to a further embodiment. The closure 810 is similar to the closures 410, 510, 610.

In some aspects and embodiments a standard neck finish is used. In other embodiments a bespoke neck finish is used.

Features of aspects and embodiments of the present invention may include:

snap-on
two-piece solution
colour change for good visibility
tamper-evident feature is retained
stable open position
useable on a 26 mm bottle neck
one hand opening
organoleptic raw materials no sharp edges
good drop test results
click at the opening
ergonomic thumb recess
during lid cap opening, bridges of an inner ring are broken and one part falls inside the cap
tamper-evident band part with change colour effect to have a better view of the first opening
thumb up recess with a hook feature
easy to open
unlock at the opening
improved drop test results
snapback hinge technology
180 degrees stable opening
high density polyethylene Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention.

The invention claimed is:

1. A container closure comprising a base part and a lid part, the base part and the lid part are joined by a hinge, the base part includes a snap bead for non-removably engaging a container neck, the lid part includes a lifting member for lifting the lid part, the lifting member comprises a retention portion for engagement with a cooperating portion on the container neck, the lifting member can be lifted to disengage the retention portion so that the lid part can be opened, in which the closure comprises a tamper-evident member and the tamper-evident member is formed separately from the base part and the lid part and in which the tamper-evident member comprises two rings, the rings are initially frangibly connected together, when the lid part is opened for the first time the rings are caused to break apart.

2. A closure as claimed in claim 1, in which the lifting member comprises a generally hyoidal shape strap or depending loop.

3. A closure as claimed in claim 1, in which the lifting member includes or defines a window and the closure includes a tamper-evident member at least part of which moves into or out of view with respect to the window to indicate opening of the closure.

4. A closure as claimed in claim 1, in which the lifting member includes or defines a window and in which the closure includes a tamper-evident member, in an initially closed position at least part of the tamper-evident member is visible in or through the window and when the lid part is moved to the open position at least part of the tamper-evident member moves at least partly out of view.

5. A closure as claimed in claim 1, in which the lifting member includes or defines a window and in which the closure includes a tamper-evident member, and in which the tamper-evident member is attached to the lid part in the window in an initially closed position and moves at least partly out of the window when the lid part is opened.

6. A closure as claimed in claim 1, in which the lifting member includes or defines a window and the closure includes a tamper-evident member, in which when the lid part is initially opened the tamper-evident member irreversibly moves to become visible in or through the window.

7. A closure as claimed in claim 1, in which the closure comprises a window and in which one of the rings is retained by the lid part and the other ring moves to become visible in or through the window.

8. A closure as claimed in claim 1, in which the retention portion includes an interior retention chin for engagement with a cooperating portion on the closure and/or on a container neck.

9. A closure as claimed in claim 1, in which the closure comprises a window and in which at least part of the window is formed as an aperture, a pane or a region of thinned material.

10. A closure as claimed in claim 1, in which the lid part comprises a top plate and in which the top plate is generally flat.

11. A closure as claimed in claim 10, in which the lid part comprises an annular plug seal which depends from the top plate.

12. A closure as claimed in claim 10, in which the lid part comprises a sidewall that depends from the generally flat top plate.

13. A closure as claimed in claim 1, in which the hinge is formed to provide a stable open position for the lid part.

14. A closure as claimed in claim 1, in which the closure is formed in a closed position or is formed in an open position.

15. A closure as claimed in claim 1, in which the closure is formed as a one-piece article or is formed as a two-piece article.

16. A closure as claimed in claim 1, in which the base part includes a snap bead for non-removably engaging a container neck.

17. A closure as claimed in claim 1 in combination with a container.

18. A container closure comprising a base part and a lid part, the base part and the lid part are joined by a hinge, the base part includes a snap bead for non-removably engaging a container neck, the lid part includes a lifting member for lifting the lid part, the lifting member comprises a retention portion for engagement with a cooperating portion on the closure, the lifting member can be lifted to disengage the retention portion so that the lid part can be opened, in which the lifting member is a generally hyoid shape, in which the lifting member is a generally hyoidal shape strap which extends radially outwardly and downwardly from the lid part generally opposite the hinge, in which the base part is a generally annular band with a generally annular snap bead provided on an interior surface thereof, and in which the lid part comprises a generally flat, disc-shape top plate and a generally annular sidewall which depends from the top plate.

19. A container closure comprising a base part and a lid part, the base part and the lid part are joined by a hinge, the base part includes a snap bead for non-removably engaging a container neck, the lid part includes a lifting member for lifting the lid part, the lifting member comprises a retention portion for engagement with a cooperating portion on the base part, the lifting member can be lifted to disengage the retention portion so that the lid part can be opened, in which closure comprises a tamper-evident member and the tamper-evident member is formed separately from the base part and the lid part and in which in which the tamper-evident member comprises two rings, the rings are initially frangibly connected together, when the lid part is opened for the first time the rings are caused to break apart.

20. A closure as claimed in claim 19, in which the lifting member is a generally hyoid shape.

* * * * *